US007019285B2

(12) United States Patent
Dresch et al.

(10) Patent No.: US 7,019,285 B2
(45) **Date of Patent: *Mar. 28, 2006**

(54) ION STORAGE TIME-OF-FLIGHT MASS SPECTROMETER

(75) Inventors: Thomas Dresch, Cambridge, MA (US); Erol E. Gulcicek, Cheshire, CT (US); Craig M. Whitehouse, Branford, CT (US)

(73) Assignee: Analytica of Branford, Inc., Branford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/808,468

(22) Filed: Mar. 14, 2001

(65) Prior Publication Data

US 2001/0030284 A1 Oct. 18, 2001

Related U.S. Application Data

(63) Continuation of application No. 09/448,857, filed on Nov. 23, 1999, now abandoned, which is a continuation of application No. 08/971,521, filed on Nov. 17, 1997, now Pat. No. 6,020,586, which is a continuation of application No. 08/689,459, filed on Aug. 9, 1996, now Pat. No. 5,689,111.

(60) Provisional application No. 60/002,118, filed on Aug. 10, 1995, provisional application No. 60/002,122, filed on Aug. 10, 1995.

(51) Int. Cl.
*H01J 49/40* (2006.01)

(52) U.S. Cl. ..... 250/287

(58) Field of Classification Search ..... 250/287, 250/286, 292, 291, 290, 281, 282
See application file for complete search history.

(56) References Cited

U.S. PATENT DOCUMENTS

| | | | | |
|---|---|---|---|---|
| 4,458,149 | A * | 7/1984 | Muga | 250/287 |
| 5,073,713 | A * | 12/1991 | Smith et al. | 250/287 |
| 5,180,914 | A * | 1/1993 | Davis et al. | 250/287 |
| 5,569,917 | A * | 10/1996 | Buttrill, Jr. et al. | 250/287 |
| 5,689,111 | A * | 11/1997 | Dresch et al. | 250/287 |
| 5,962,851 | A * | 10/1999 | Whitehouse et al. | 250/287 |
| 6,020,586 | A * | 2/2000 | Dresch et al. | 250/287 |

* cited by examiner

*Primary Examiner*—Kiet T. Nguyen
(74) *Attorney, Agent, or Firm*—Levisohn, Berger & Langsam, LLP

(57) ABSTRACT

A method and an apparatus which combines at least one linear two dimensional ion guide or a two dimensional ion storage device in tandem with a time-of-flight mass analyzer to analyze ionic chemical species generated by an ion source. The method improves the duty cycle, and therefore, the overall instrument sensitivity with respect to the analyzed chemical species.

5 Claims, 13 Drawing Sheets

ION STORAGE TIME-OF-FLIGHT MASS SPECTROMETER

RELATED APPLICATIONS

This application is a continuation of U.S. patent application Ser. No. 09/448,857 filed Nov. 23, 1999 now abandoned, which is a continuation of U.S. patent application Ser. No. 08/971,521 filed Nov. 17, 1997 (issued on Feb. 1, 2000 as U.S. Pat. No. 6,020,586), which is a continuation of U.S. patent application Ser. No. 08/689,459 filed Aug. 9, 1996 (issued on Nov. 18, 1997 as U.S. Pat. No. 5,689,111), and which claims the priority of U.S. Provisional Application Ser. No. 60/002,118 and U.S. Provisional Application Ser. No. 60/002,122, both filed Aug. 10, 1995. The disclosures of all of those applications and patents are hereby fully incorporated into this application by reference.

FIELD OF THE INVENTION

This invention relates in general to mass spectrometers and in particular to the use of Time-Of-Flight mass spectrometers in combination with two dimensional ion traps that are also used as ion guides and ion transport devices.

BACKGROUND OF THE INVENTION

In a time-of-flight mass spectrometer, ions are accelerated by electric fields out of an extraction region into a field free flight tube which is terminated by an ion detector. By applying a pulsed electric field or by momentary ionization in constant electric fields, a group of ions or packet starts to move at the same instant in time, which is the start time for the measurement of the flight time distribution of the ions. The flight time through the apparatus is related to the mass to charge ratios of the ions. Therefore, the measurement of the flight time is equivalent to a determination of the ion's m/z value. (See, e.g., the Wiley and McLaren; and, the Laiko and Dodonov references cited below).

Only those ions present in the extraction zone of the ion accelerator, (also referred to as "the pulser"), in the instant when the starting pulse is applied are sent towards the detector and can be used for analysis. In fact, special care must be taken not to allow any ions to enter the drift section at any other time, as those ions would degrade the measurement of the initial ion package.

For this reason, the coupling of a continuously operating ion source to a time-of-flight mass spectrometer suffers from the inefficient use of the ions created in the ion source for the actual analysis in the mass spectrometer. High repetition rates of the flight time measurements and the extraction of ions from a large volume can improve the situation, but the effective duty cycles achieved varies as a function of mass and can be less then 10% at low mass.

If extremely high sensitivity mass analysis is required or if the number of ions created in the ion source is relatively small, there is need to make use of all the ions available. This requires some sort of ion storage in-between the analysis cycles. Time-of-flight instruments that use dc plate electrode configurations or three dimensional quadrupole ion traps for ion storage have been built and operated successfully. (See e.g., the Grix, Boyle, Mordehai, and Chien references cited below). While the storage efficiency of dc configurations is limited, with three dimensional quadrupole ion traps a compromise between efficient collisional trapping and collision free ion extraction has to be found.

In one embodiment of the present invention, a multiple pumping stage linear two dimensional multipole ion guide is configured in combination with a time-of-flight mass spectrometer with any type of ionization source to increase duty cycle and thus sensitivity and provide the capability to achieve mass to charge selection. Previous systems, such as the three dimensional ion trap/time-of-flight system of Lubman (cited below), have combined a storage system with time-of-flight, however, these systems' trapping time are long, on the order of a second, thus not taking full advantage of the speed at which spectra can be acquired and thereby limiting the intensity of the incoming ion beam. In addition, the three dimensional ion trap is strictly used as the acceleration region and storage region. Also, 100% duty cycle is not possible with the three dimensional ion trap TOF system due to the fact that the three dimensional ion trap can not be filled and emptied at the same time; in addition, there are currently electronic limitations with the operation of three dimensional ion traps (See e.g., Mordehai, cited below). In the embodiment of the invention described herein, it is possible to fill and release ions simultaneously from a two dimensional ion trap configured in a Time-Of-Flight mass analyzer resulting in improved duty cycle and hence sensitivity.

The use of a two dimensional multipole ion guide to store ions prior to mass analysis has been implemented by Dolnikowski et al. on a triple quadrupole mass spectrometer. A more recent combination was made by Douglas (U.S. Pat. No. 5,179,278) who combined a two dimensional multipole ion guide with a quadrupole ion trap mass spectrometer where all ions trapped in the multipole ion guide were emptied into the three dimensional ion trap prior to each time-of-flight pulse. Both of these systems are quite different from the current embodiment. In both of the above systems, the residence times of the ions in the linear two dimensional quadrupole ion guide were over 1–3 seconds, whereas, in the current embodiment the ions can be stored and pulsed out of the linear two dimensional multiple ion guide at a rate of more than 10,000/sec, thus utilizing much faster repetition rates. Due to the inherent fast mass spectral analysis feature of the time-of-flight mass analyzers, continuously generated incoming ions are analyzed at a much better overall transmission efficiency than the dispersive spectrometers such as quadrupoles, ion traps, sectors or Fourier Transform mass analyzers. When an ion storage device is coupled in front of a dispersive mass analyzer instrument, the overall transmission efficiency of an instrument, no doubt, increases; however, since the ion fill rate into the storage device is much faster than the full spectral mass analysis rate, the overall transmission efficiencies are limited by the mass spectral scan rates of the dispersive instruments which are at best on the order of seconds. Time-of-flight mass analyzers, on the other hand, can make full use of the fast fill rates of the incoming continuous stream of ions since the full mass spectral time-of-flight pulse rates of 10,000 per second and more can well exceed the fill rates into a storage device. One aspect of the invention is that only a portion of the ions stored in the two dimensional ion trap are released into the time-of-flight region for each time-of-flight pulse, allowing an increase in duty cycle and sensitivity when compared with non trapping time-of-flight operation.

Also unique to this embodiment is the fact that the ion packet pulse out of the linear two dimensional multipole ion guide forms a low resolution time of flight separation of the different m/z ions into the pulser where the timing is critical between when the pulse of ions are released from the linear two dimensional multipole ion guide and the time at which the pulser is activated. This is to say that the linear two dimensional multipole ion guide pulse time and the delay time to raise the pulser can be controlled to achieve 100% duty cycle on any ion in the mass range or likewise a 0% duty cycle on any ion in the mass range or any duty cycle in between. Also, as pointed out by Douglas (U.S. Pat. No. 5,179,278), an ion guide can hold many more ions than what the ion trap mass analyzer can use. This decreases the duty cycle of the system if all trapped ions are released together to be mass analyzed. In contrast, that is not an issue in the current embodiment as only a portion of the trapped ions are mass analyzed per time-of-flight pulse.

As the linear two dimensional multipole ion guide trap is filled with more ions, the space charging effects or coulombic interactions between the ions increase resulting in two major consequences. First, the mass spectral characteristics may change due to overfilling of the storage device where more fragmentation will occur due to strong ionic interactions. Second, the internal energy of the ions will increase, making it harder to control and stop the ions going into a mass analyzer device. The above problems can again be overcome using a time-of-flight mass analyzer at fast scan rates which will not allow excessive charge build up in the storage ion guide. Operating at very fast acquisition rates, the time-of-flight instrument does require intricate timing of the trapping and the pulsing components.

BRIEF DESCRIPTION OF THE INVENTION

It is the principal object of this invention to provide means for increasing the sensitivity and detection limits of a continuous stream of ionic chemical species generated externally in a time-of-flight mass spectrometer.

It is a further object of this invention to provide means for increasing the sensitivity and detection limits of said time-of-flight instrument by increasing the duty cycle of the mass analysis.

It is a further object of this invention to improve the resolution time-of-flight mass analysis by supplying a tightly spaced packet of ions into the time-of-flight pulsing region.

In accordance with the above objects, a multipole ion guide device with accompanying ion optics and power supplies, switching circuitry, and timing device for said switching circuitry is provided to increase efficiency of ion throughput into the time-of-flight mass analyzer.

These and further objects, features, and advantages of the present invention will become apparent from the following description, along with the accompanying figures and drawings.

DETAILED DESCRIPTION OF THE PREFERRED EMBODIMENTS

Figure 1:
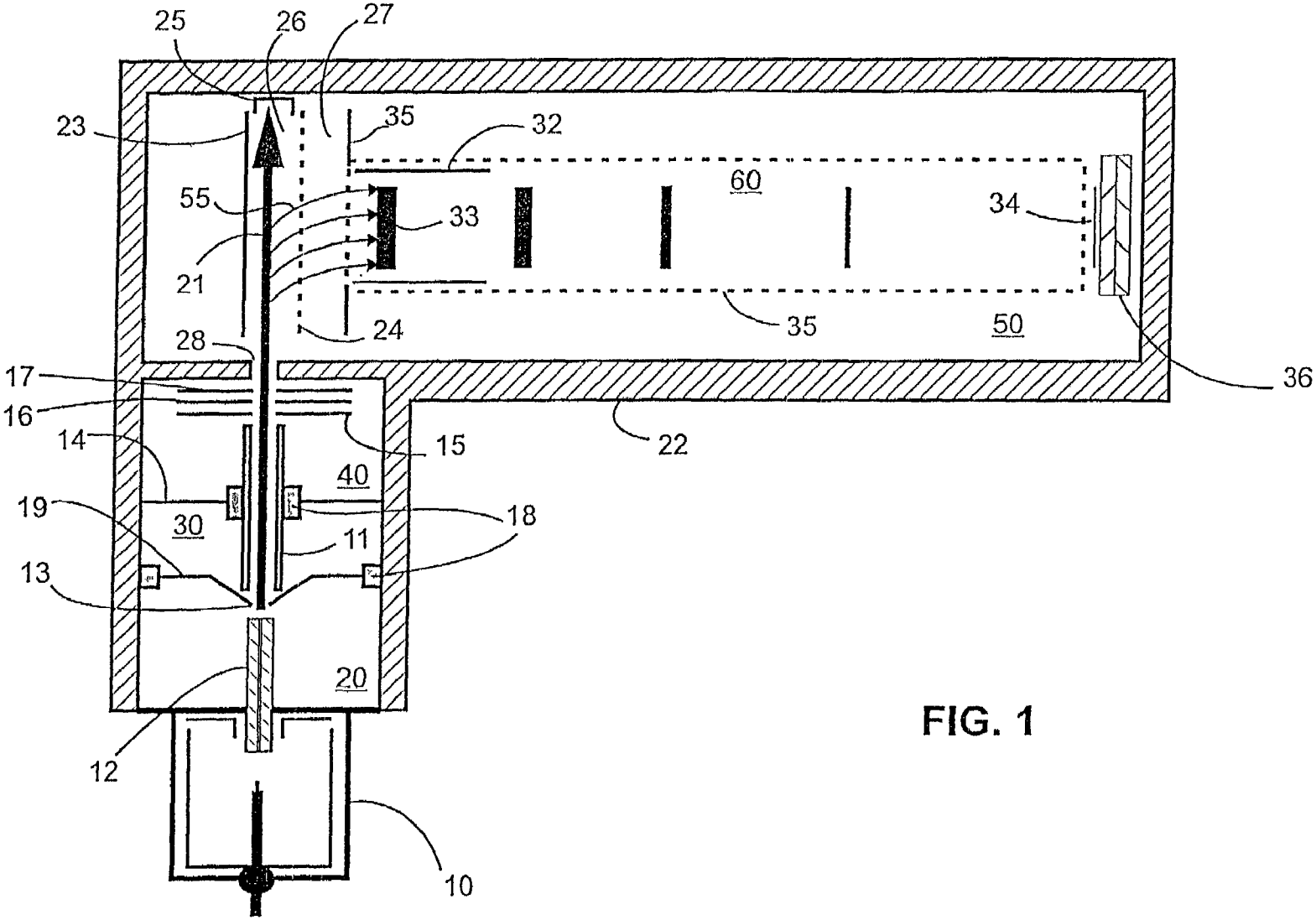
FIG. 1 is a schematic representation of a simple linear time-of-flight mass analyzer utilizing orthogonal acceleration with an atmospheric pressure ionization source.
Figure 2:
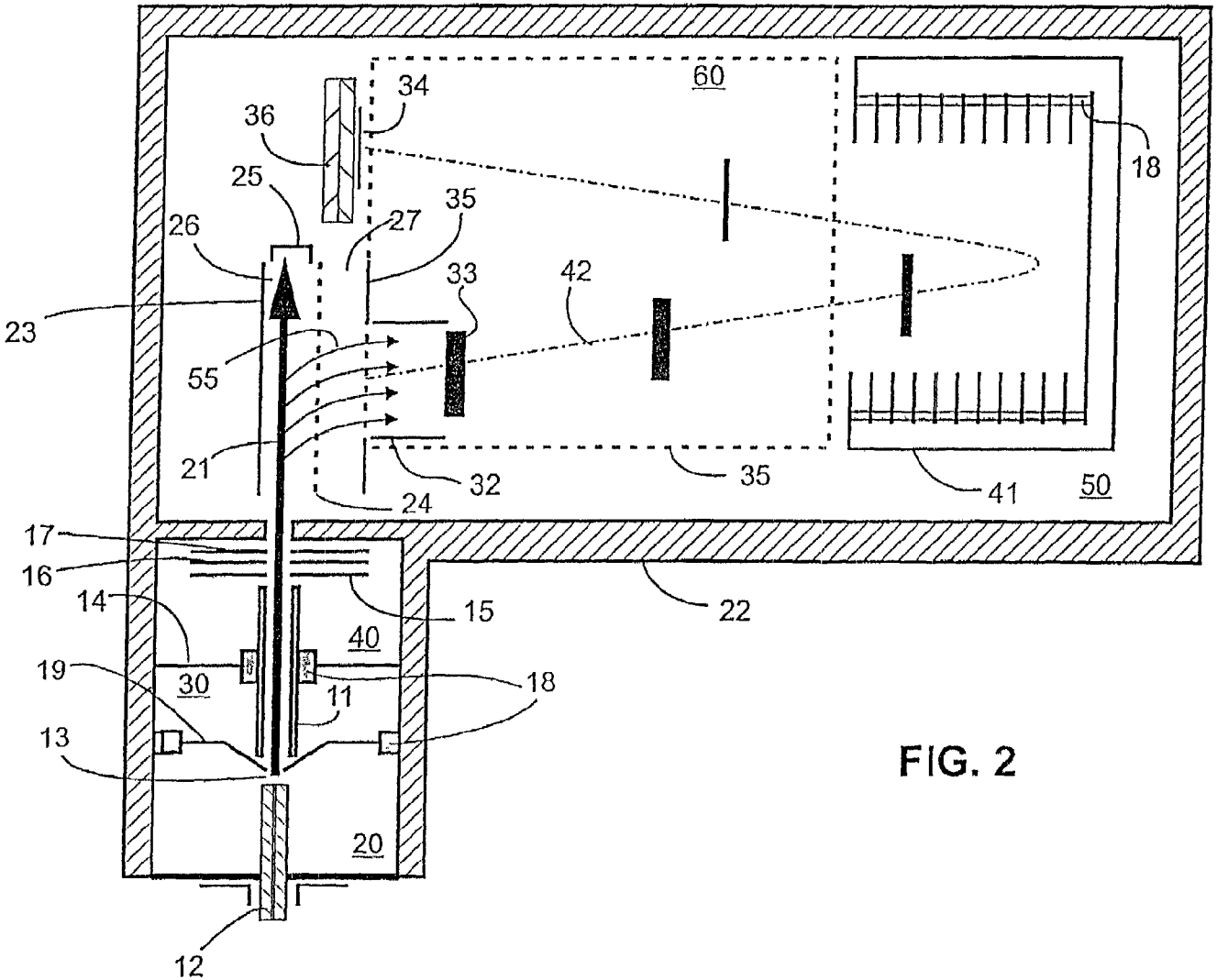
FIG. 2 is a schematic representation of a simple reflectron time-of-flight mass analyzer utilizing orthogonal acceleration with an atmospheric pressure ionization source.
Figure 8:
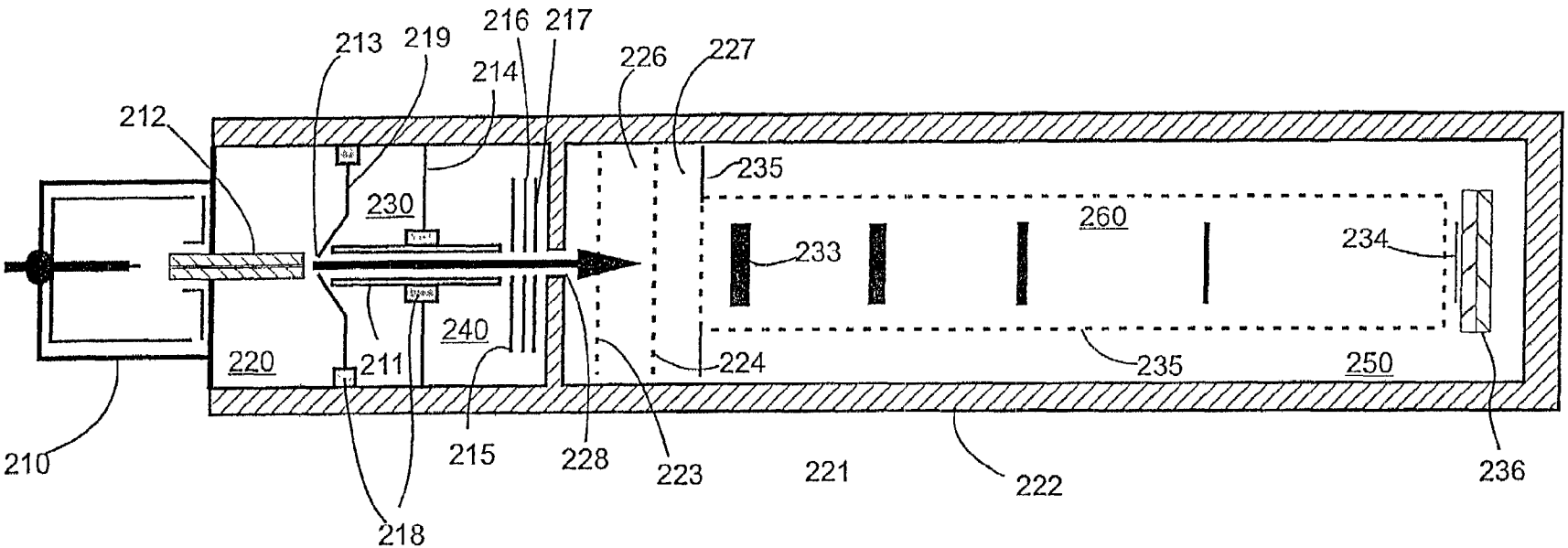
FIG. 8 is a schematic representation of a linear multipole ion guide time-of-flight mass analyzer configuration utilizing axial acceleration with an atmospheric pressure ionization source.
Figure 11:
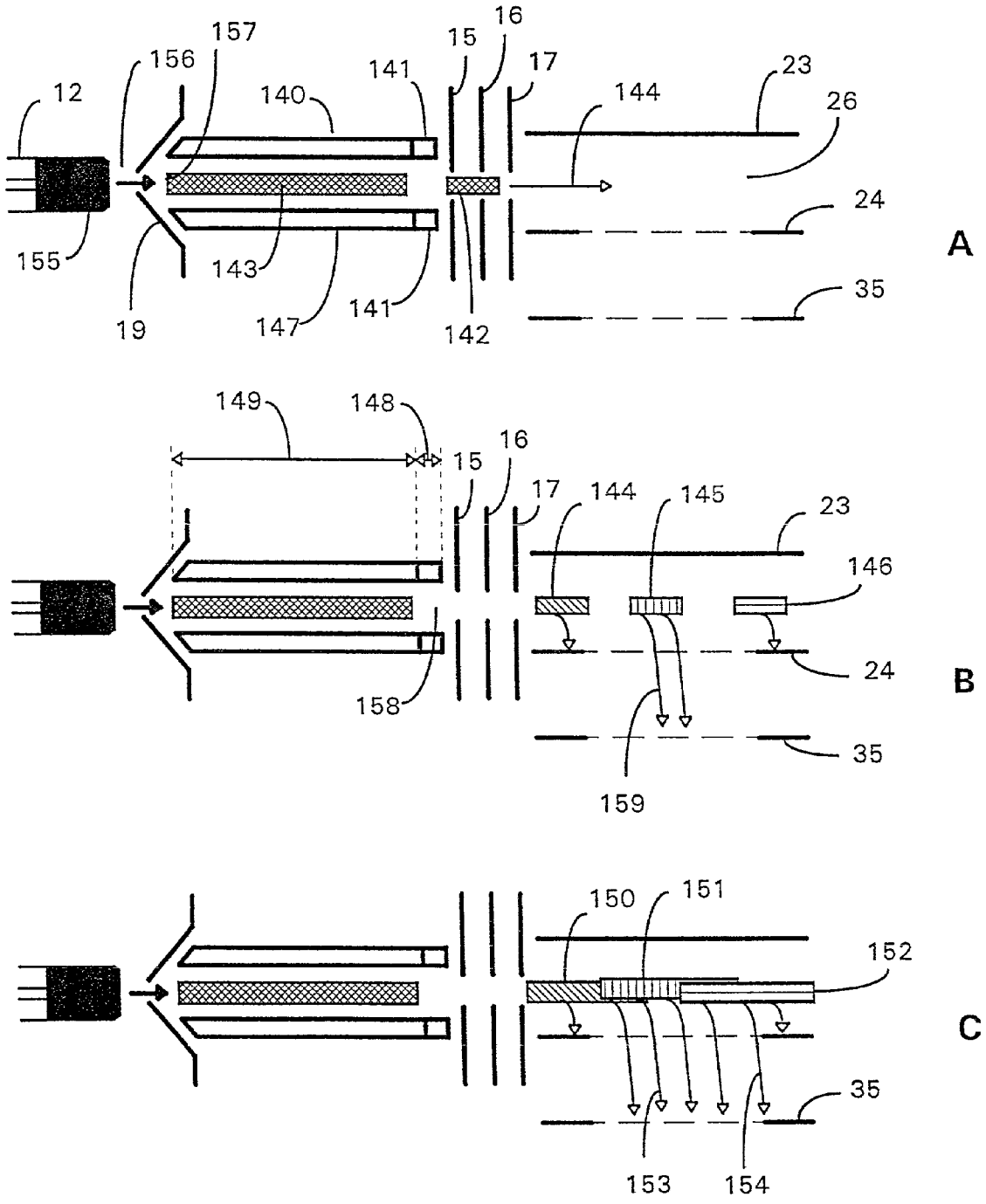
FIGS. 11A, B and C diagram the release of ions trapped in a segmented ion guide illustrating the subsequent time of flight separation prior pulsing into the fire-of-flight mass analyer.

Among the many atmospheric pressure ionization time-of-flight mass spectrometer configurations covered by prior art, FIG. 1 and FIG. 2 show two time-of-flight configurations which illustrate preferred embodiments of the present invention. FIG. 8 shows an alternative configuration which illustrates a different embodiment of the invention. FIG. 11 shows another alternative embodiment of the inventions described herein which includes a segmented multipole ion guide. The preferred embodiments of the inventions as diagrammed in FIGS. 1 and 2 are configured with an external ion source 10 and a means for transporting the ions from the atmospheric pressure ionization source to the mass analyzer all of which are encased by the vacuum housing walls 22. Both the ions and the background gas are introduced into the first stage pumping region 20 by means of a capillary interface 12 and are skimmed by a conical electrostatic lens 19 with a circular aperture 13. The ions are formed into a primary beam 21 by a multipole ion guide 11 having round rods or hyperbolic rods and are collimated and transferred into the pulsing region 26 of the time-of-flight mass analyzer by transfer ion optic electrostatic lenses 15, 16, and 17. The multipole ion guide can be a multipole ion guide extending through multiple vacuum pumping stages, according to the preferred embodiment or the multipole ion guide may be located entirely in one vacuum pumping stage. Multipole ion guides extending through multiple vacuum pumping stages are described in U.S. Pat. No. 5,652,427 and application Ser. Nos. 08/689,549 (filed Aug. 9, 1996) and Ser. No. 08/694,540 (filed Aug. 9, 1996), the disclosures of which are hereby incorporated herein by reference. Alternatively, separate multipole ion guides configured in separate vacuum pumping stages can be used.

Electrically insulating materials such as spacers 18 are used to isolate the various ion optic lenses throughout the apparatus. Along the path of the transfer ion optics, the gas density is reduced progressing through four different pumping stages. Skimmer orifice 13 restricts the neutral gas flow between the first and the second pumping stages 20 and 30, the ion guide support bracket 14 and the ion guide itself acts as a partition between the pumping stages 30 and 40. An aperture 28 in the vacuum housing 22 separates the third pumping stage 40 from the fourth pumping stage 50 where the time-of-flight mass analyzer components reside. The four vacuum stages can be pumped conventionally with a combination of turbo and mechanical pumps. Alternatively, other vacuum pump types including but not limited to cryopumps or diffusion pumps may be configured with additional or fewer vacuum pumping stages to achieve the desired vacuum pressures.

The time-of-flight (TOF) mass analyzers shown in FIG. 1 and FIG. 2 are said to be operating in an orthogonal injection mode because ions generated outside of the time-of-flight mass spectrometers are transferred into the time-of-flight pulsing region 26 in a direction substantially perpendicular to the direction of the accelerating fields generated in the time-of-flight pulsing regions 26 and 27 defined by the potentials applied to electrostatic lenses 23, 24, and 35 (See e.g., the O'Halloran et al., Dodonov et al., USSR Patent SU-1681340 references cited below). Primary ion beam 21 enters the time-of-flight analyzer through aperture 28 and traverses the first accelerating or the extraction region 26. A Faraday cup 25 is used to monitor and optimize the ion current of primary ion beam 21 into pulsing region 26 when the electric field is off, i.e. the voltage applied to repeller plate 23 is approximately equal to the voltage applied to draw-out plate and grid 24. Typically the voltage applied to repeller plate 23 is approximately ground voltage potential when the time-of-flight tube electrostatic element 35 is maintained at a higher potential. By applying a pulsed electric field momentarily between the repeller lens 23 and the draw-out lens 24, a group of ions 33 starts to move instantaneously in direction 55 through the second stage acceleration field set by the plates or grids 24 and 35 and continues towards the time-of-flight tube field free drift region 60 surrounded by the flight tube electrostatic element 35. The pulsed electric field generated by the pulsing of repeller lens 23 establishes the start time for the measurement of the flight time distribution of the ions arriving at detector 36. The flight time through the apparatus is related to the mass to charge ratios of each ion. Therefore the measurement of the flight time is equivalent to a determination of an ion's m/z value. To offset or adjust the direction of the ion packet 33 to hit the detector 36, deflector lens set 32 may be configured after the acceleration region 27 and inside the field free drift region 60. If the deflectors are not used with orthogonal injection, the detector can to be placed off axis at a position to account for the energy of the ions in the direction of primary ion beam 21.

The mass resolution of a time-of-flight mass spectrometer is defined as $m/\Delta m = t/2\Delta t$ where m is the ion mass, $\Delta m$ is the width of the ion package arriving at the detector at full width half maximum(FWHM), t is the total flight time of this ion, and $\Delta t$ is the arrival time distribution at the detector measured at FWHM. As a result, higher resolution can be achieved in one of two ways: increase the flight time of ions or decrease the arrival time distribution of the ions at the detector. Given a fixed field free drift length, the latter is achieved in the present mass spectrometer with a two stage accelerator of the type first used by Wiley and McLaren. The electric fields in the two acceleration regions 26 and 27 are adjusted by the voltages applied to the lenses 23, 24, and 35 such that all ions of the same m/z start out as a package of ions 33 with a finite volume defined by the acceleration region 26 and end in a much narrower package 34 when they hit the detector. This is also called the time-space focusing of the ions which compensates for the different initial potential energy of the ions located in different positions in the electric field in region 26 during the pulse. The time-space focusing of the ions does not however compensate for the different energy distribution of the ions along the direction of the acceleration field before the field is turned on. The degree of the energy spread component of the ions in the acceleration axis affects the time distribution of the ions arriving at the detector. The larger the spread of energy of the ions in this direction, the lower will be the mass resolving power of the instrument. The orthogonal injection of the ions does minimize, to some degree, the energy spread of the externally injected ions in the direction of the time-of-flight acceleration resulting in a narrower package of ions hitting the detector. To further increase the resolution of the time of flight instrument caused by the energy spread of the ions, a reflectron of the type first used by Mamyrin (cited below) can be used. FIG. 2 shows such an instrument which is the same as in FIG. 1, except a reflectron 41 is added for operating the mass analyzer to achieve higher resolution and higher mass accuracy.

The coupling of continuously operating ion sources 10 to a time-of flight mass spectrometer suffers from the inefficient use of the ions created in the ion source for the actual analysis in the mass spectrometer. High repetition rates of the flight time measurements counted by the pulsing, of the repeller lens 23 and the extraction of ions from an elongated volume 26 can improve the situation, but with pulsing of a continuous primary ion beam the effective duty cycles achieved are still of the order of 1 to 50%.

Figure 3:
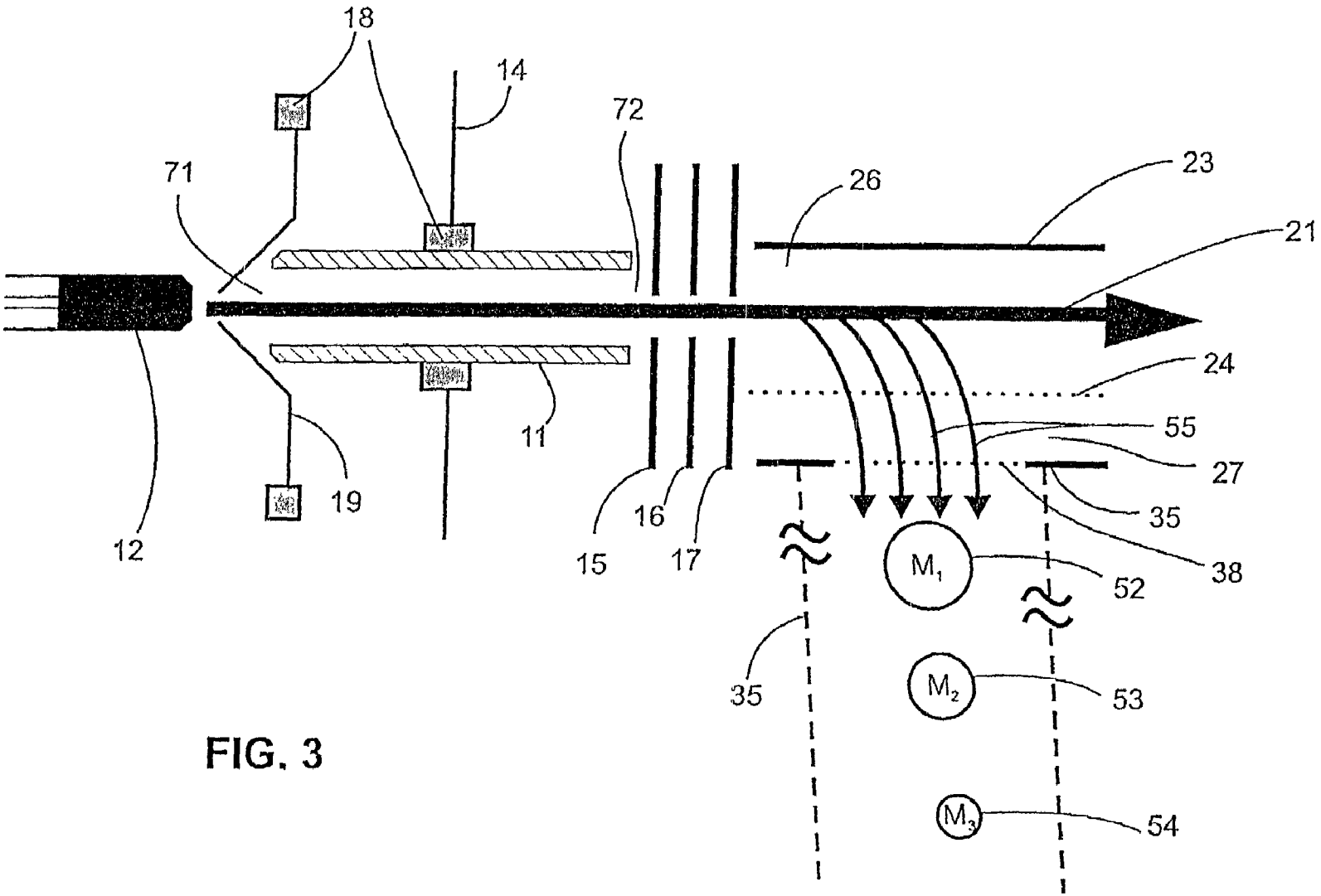
FIG. 3 is a schematic drawing of the interface ion optics between the ion source and the mass analyzer.

To demonstrate the point, consider a continuous primary beam of ions 21 in FIG. 3 having a mixture of three ions 52, 53, and 54 with molecular weights 997 ($M_1$), 508 ($M_2$), and 118 ($M_3$) entering pulsing region 26 with an electrostatic energy of 10 eV. With these parameters, the approximate velocity of the ions traveling through the acceleration region 26 in the absence of a pulsing field would be 4 mm/μs, 1.9 mm/μs, and 1.4 mm/μs, respectively. If practical experimental parameters are used, for example, a 10,000 repetition rate per second of repeller lens 26 (a TOF pulse occurring every 100 μs) and 20 mm of pulsing region length determined by the mesh size opening 38 on the lens 35, for every one ion of mass $M_1$ 52, $M_2$ 53 and $M_3$ 54, pulsed in the direction 55 of the time-of-flight analyzer detector, seven, ten, and twenty ions will be lost going in the direction of primary ion beam 21. The approximate calculated duty cycles for the ions $M_1$ 52, $M_2$ 53, and $M_3$ 54, will be 14%, 10%, and 5%, respectively for time-of-flight pulsing from a continuous ion beam In order to achieve higher extraction duty cycles with continuous ion beams, several variables and parameters can be adjusted. For example, repetition rates of 20,000 Hz or more can be used, however, this pulse rate is limited by the flight time of the ion m/z range of interest in flight tube 60. Also, the primary ion beam average ion energy can be lowered, or the extraction region can be extended in the direction of the ion beam 21. Difficult to build or expensive to buy mass analyzer components such as detectors with larger surface areas, faster data acquisition systems etc., are needed to achieve higher duty cycles. Many of these chances will result in an increase of duty cycles by a factor of two approximately before practical limitations are exceeded.

Figure 4:
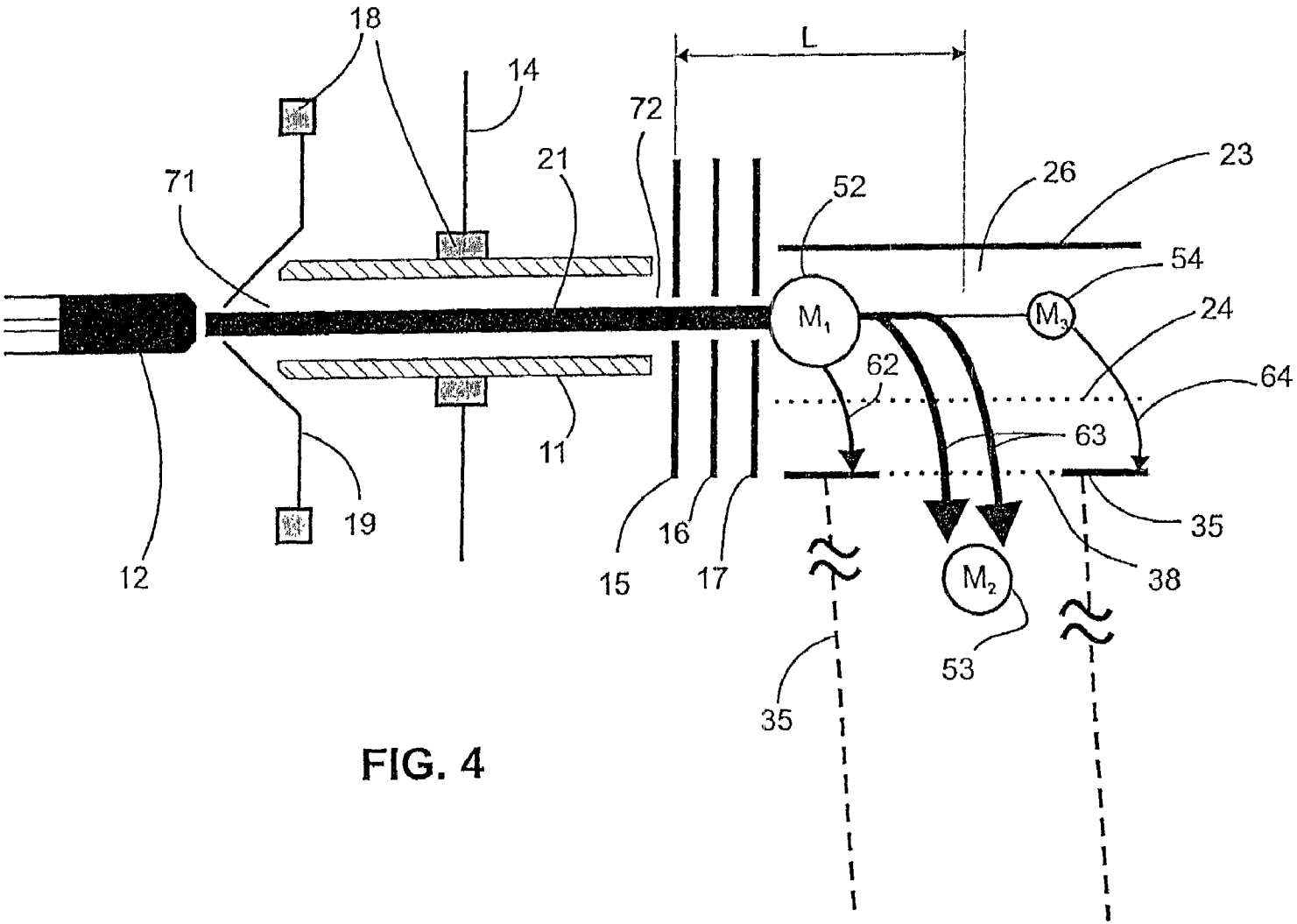
FIG. 4 is a schematic drawing of the interface ion optics between the ion source and the mass analyzer using a two dimensional ion trap.
Figure 5:
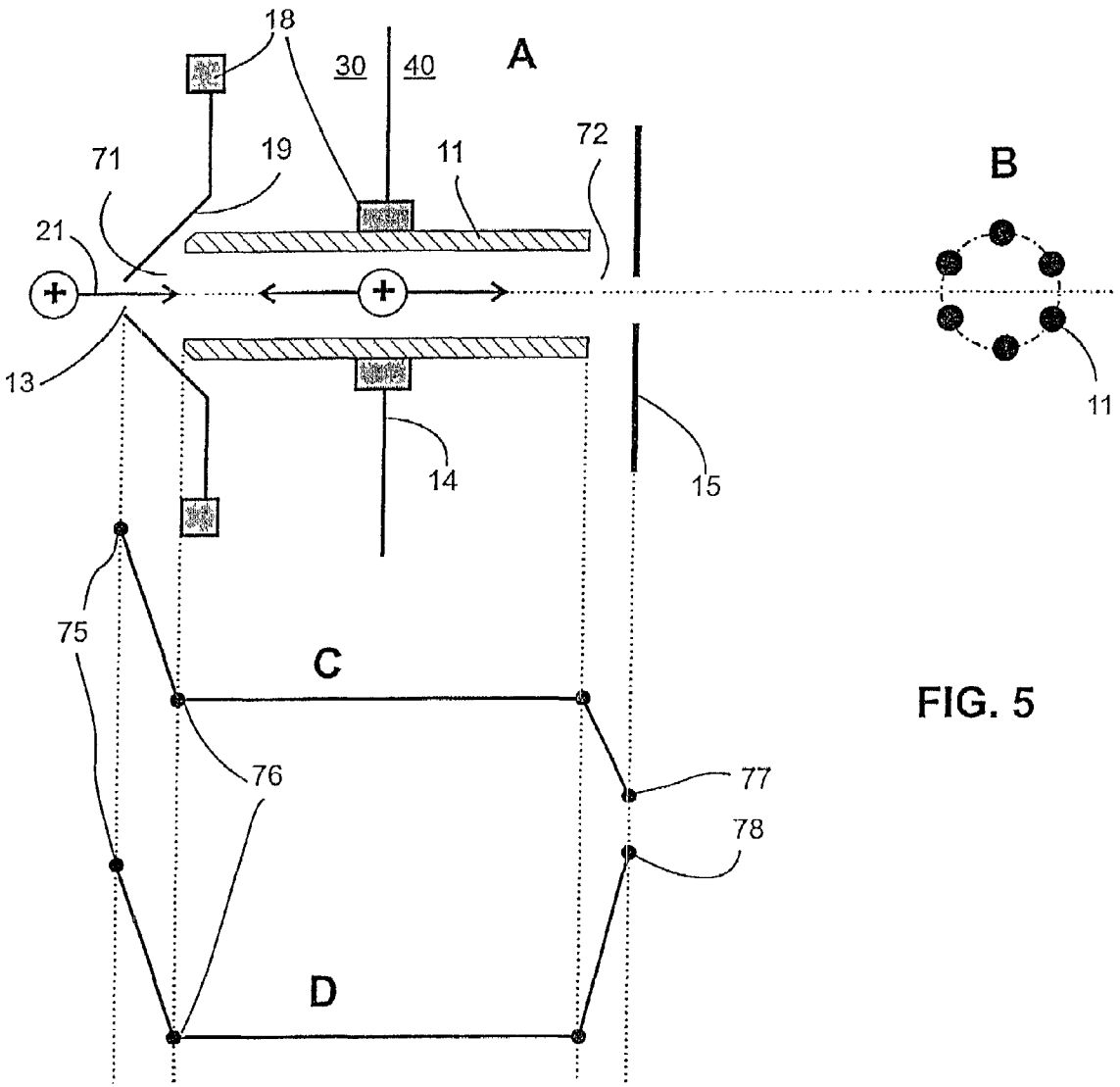
FIG. 5 is a detailed view of the ion guide and the surrounded ion optics (A), cross section of a multipole ion guide with six rods (B), electrostatic voltage levels on the said ion optics when the ions are released (C) and trapped (D).
Figure 6:
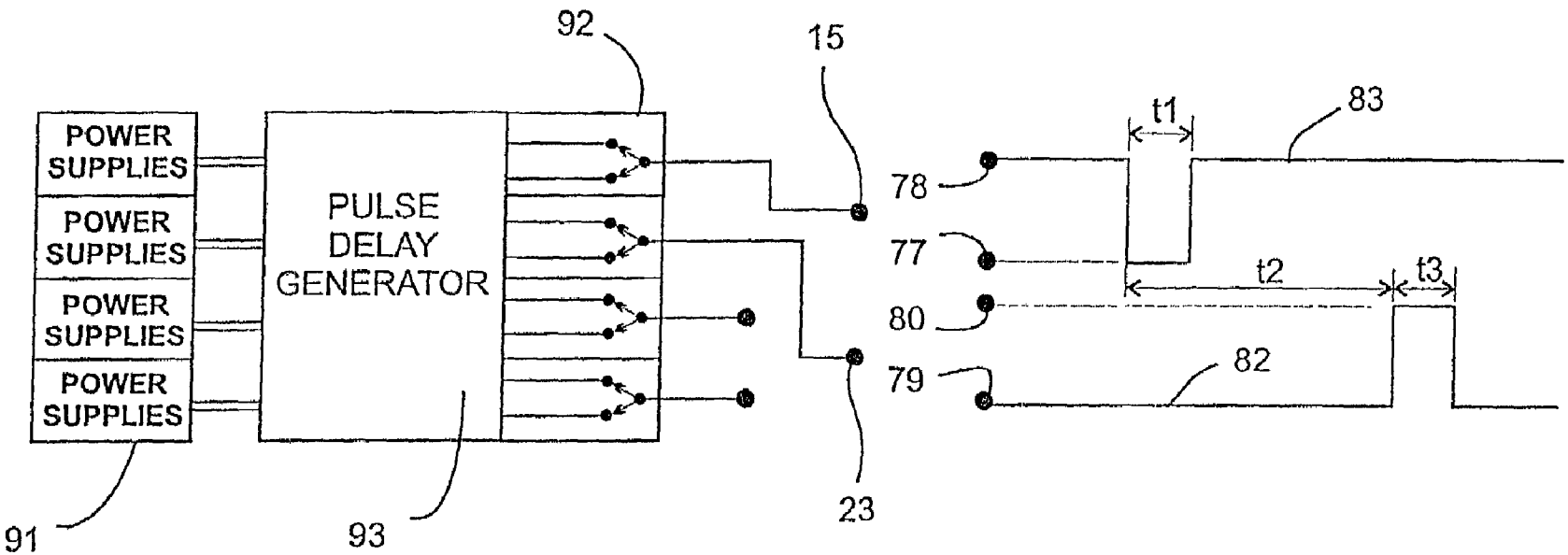
FIG. 6 is the relative timing diagram of the ion guide exit lens and the time-of-flight repeller lens voltages.

To make use of the limited number of ions generated in ion source 10, an apparatus which stores ions in-between the time of flight analysis pulses is required. FIG. 3 is a diagram of a section of a time-of-flight mass spectrometer that utilizes a multipole ion guide operated in a manner that can continuously receive ions from a continuous ion beam generated in an external ion source. The multipole ion guide can be operated to gate or release a portion of the trapped ions into the pulsing region of the time-of-flight mass analyzer. While continuing to receive ions into its entrance end, FIG. 4, FIG. 5 and FIG. 6 show the same multipole ion guide being used in a trapping or ion storage mode of operation with applied voltages from appropriate power supplies controlled by a multiple voltage switch and pulse switch delay generators.

In recent years, the commercial use of such RF-only multipole ion guides have been practiced widely in continuous mode, especially in mass spectrometers interfaced with atmospheric pressure ionization (API) sources. The number of rods or poles configured in the multipole ion guide assemblies may vary; the examples in this invention will show predominantly hexapole, meaning six round or hyperbolic, equally spaced in a directionally parallel, set of rods 11 as shown in FIG. 5B. As an alternative to hexapole ion guide configurations, quadrupoles (four poles), octopoles (eight poles) or ion guides configured with more than eight rods or poles can be operated as ion traps in the embodiments of the invention described herein. Alternate rods in ion guide 11 are connected together to an oscillating electrical potential. Such a device is known to confine the trajectories of charged particles in the plane perpendicular to the primary ion beam 21 axis, whereas motion in the axial beam direction is free giving rise to the term, "two dimensional ion trap". Depending on the frequency and amplitude of the oscillating electrical potential, stable confinement can be achieved for a broad range of values of the mass to charge ratio along the primary beam axis. A DC bias voltage potential 76 is applied to all the rods to define the mean electrical potential of the multipole with respect to the electrical potential applied to ion guide entry conical electrode or skimmer 19 with voltage 75 and with respect to the ion guide exit electrode 15 electrical potential set by applying voltage values 77 or 78.

As diagrammed in FIG. 5C, in the continuous mode of operation, for a positively charged stream of ions 21 to enter and be focused into the ion guide through skimmer orifice 13, the voltage value 75 applied to conical electrode or skimmer 19 is set higher than the bias voltage value 76 applied to the ion guide rods 11. By the same token, to accelerate and focus the ions beyond the ion guide, a voltage value 77 which is less than the bias voltage value 76, is applied to ion guide exit lens electrode 15. When ion guide 11 is operated in the storage mode as diagrammed seen in FIG. 5D, the voltage value on ion guide exit lens electrode 15 is raised from 77 to 78 which is higher than the ion guide bias voltage 76. This higher voltage value 78 on lens electrode 15 repels the ion in the exit region 72 of the ion guide back towards the entrance region 71 of the ion guide. As evident from FIG. 5D, the voltage values set in this manner form a potential well in the longitudinal direction of the ion guide efficiently preventing the ions from leaving the ion guide.

A particularly useful feature of the ion guide with regards to this invention is the higher gas pressure in the ion entry region 71 and the region up to the second and third pumping stage partitioning wall 14 inside the ion guide. Due to the expanding background gas jet, the pressure in pumping stage 30 is higher than the free molecular flow pressure regime with gas flowing and becoming less dense in the direction of the ion beam 21. This feature accomplishes two important functions in the time-of-flight instrument. First, due to collisional cooling, it sets a well defined and narrow ion energy of the beam 21 with an average ion energy approximately equal to the multipole ion guide bias potential 76. Second, it allows high efficiency trapping of the ions along the ion guide enclosed by the rods of ion guide 11, conical lens 19 and exit lens 15.

Both in the continuous mode of operation and in the storage mode, the final electrostatic energy of the ions entering the time-of-flight analyzer pulsing region 26 is determined by the voltage difference set between the ion guide bias voltage 76 and the time-of-flight repeller plate 23 when the field is off. Due to collisions with the molecules of the dense gas jet in the region 71, the ions do not gain kinetic energy in the electric field but slide gradually down the electric potential well shown in FIG. 5D. In this way, they attain a total energy close to the bias potential 76. Alternatively, a multipole ion guide can be configured to trap ions in a low pressure vacuum region. Ions can be trapped in a multipole ion guide and released into a time-of-flight pulsing region without ion collisions with neutral background gas. However, collisional damping of ion trajectories in the ion guide improves trapping efficiency and reduces ion energy spread of ions released into the time-of-flight pulsing region. As described in the preferred embodiment of the invention, the reduced ion energy spread and the ability to control the release of ions into the time-of flight pulsing regions results in improved time-of-flight sensitivity and resolution performance when compared with that achieved with non-trapping operation.

The ion guide rods 11 extend both through the second 30 and third 40 pumping stages without any interruptions; they allow ions to flow freely in the forward and backward directions in the ion guide with close to 100% efficiency. Ions enter ion guide 11 in higher pressure region 71 but exit in a lower pressure region 72 free of collisions with neutral background gas. As ions move backwards towards the conical lens 19, voltage 75 applied to conical electrode 19 and the higher gas density moving in the forward direction prevents the ions from hitting the walls of the conical lens or leaving through ion guide region 71. The ions are efficiently brought to thermal equilibrium by these multiple collisions with residual or bath gas molecules while ions from the ion source are constantly filling the multipole ion guide 11 trap through conical lens aperture 13. The collisional damping due to the higher pressure in vacuum stage 30 also allows ions to traverse back and forth multiple times inside ion guide 11 with little or no ion loss. As a result, the ion guide exit lens voltage 78 can be adjusted to values not only higher than the bias voltage 76, but also to values higher than the conical lens voltage 75. If the higher pressure region 71 was absent in the ion guide, a voltage setting 78 higher than 75 would cause ions to collide with conical lens 19 after a single pass. Without the higher pressure region 71, the voltage settings 75, 76 and 78 would be more critical and difficult to set with respect to each other for efficient trapping of the ions in the ion guide.

As the voltage on the exit lens 15 is switched from level 78 to 77 for a short duration (on the order of microseconds), high density ion bunches are extracted collision free from the low pressure storage region 72 and injected into the orthogonal time-of flight analyzer. The mechanism for the storage mode of operation can be seen in FIG. 4. The ions are subsequently accelerated and focused by means of additional electrodes 16 and 17. The voltages applied to electrodes 16 and 17 in the embodiment described are held at a constant value. Alternatively, the voltage values can be switched synchronously to the switching of potentials applied to lens 15 as will be described below for different embodiments of the invention. After being pulsed out of the region 72, all ions of the packet originally extracted will have, to a first order approximation, the same final kinetic energy $qU_0$, where $U_0$ is the total accelerating potential difference between the ion guide bias voltage 76 and the time-of-flight repeller lens voltage when the field is off in pulsing region 26. Ions of a specific mass to charge ratio will have a final velocity which is proportional to the reciprocal square root of this ratio:

$$v_0 = k_1 \cdot \sqrt{\frac{2 \cdot q \cdot U_0}{m}} \tag{1}$$

Here, $k_1$ is a constant, q=ze is the charge of the ion, and m is its mass. Ions will travel a distance L to arrive at the same point in the pulsing region 26 after a certain time T shown by $$T_m = k_2 \cdot \frac{L}{v_0} \tag{2}$$

$k_2$ is a constant that takes into account the ion acceleration process. Hence, ions with a different m/z ratio will pass a point in region 26 at times which differ by the relationship:

$$T_1 - T_2 = \frac{k_2 \cdot L}{k_1 \cdot \sqrt{2 \cdot e \cdot U_0}} \left[ \sqrt{\frac{m_1}{z_1}} - \sqrt{\frac{m_2}{z_2}} \right] \tag{3}$$

Accordingly, the initial ion package is spread out in space along the region 26 in the direction of the primary ion beam 21.

FIG. 6 shows the driving mechanism and the timing sequence between potentials applied to ion guide exit lens 15 and time-of-flight repeller lens 23 for a single cycle, i.e. a gated release of trapped ions followed by a pulsing of released ions into time-of-flight tube 60. Trace 83 shows the ion guide exit lens voltage status switching between the two voltage levels 77 and 78 and trace 82 shows the repeller lens voltage status switching between the two levels 79 and 80. Power supply 91 sets the desired upper and lower voltage levels to be delivered to the lenses at all times. The electrically isolated fast switching circuitry 92 controls the desired voltage level to be switched back and forth during the designated time intervals controlled by pulse and delay generating device 93 which in turn can be set and controlled through manual adjustment of values or through a computer user interface.

As an example of the ion storage mode of operation, let us again use the same mixture of ions $M_1$, $M_2$, and $M_3$ of ionic masses 997, 508 and 118 as used above in continuous mode of operation. As shown in FIG. 4 and FIG. 6 ions trapped in ion guide 11 are released during, the gate release time period. Ions released as a packet from region 72 move into time-of-flight pulsing region 26 between the parallel plates 23 and 24 when the plates are initially held at the absence of an electric field, i.e. voltage level 79 is applied to repeller lens 23. According to equation (3) above, lighter ions move faster than the heavier ions resulting in separation or partial separation of the three masses from each other as they move into region 26. After a certain variable delay t2, the electric field in the region 26 is pulsed on for a short period of time t3 applying voltage level 80 to repeller plate 23. The delay time t2 can be changed to allow different sections of the original ion beam, i.e. different m/z packages, to accelerate perpendicular to their original direction towards the flight tube 35 to be detected for mass analysis. As an example, a delay time t2 was chosen to pulse only a narrow range of ions centered around mass ($M_2$) 53 which were accelerated in the direction 63 at the instant the field in region 26 was turned on. At the same instant, both the masses $M_1$ 52 and $M_3$ 54 will hit the sides of the lenses moving in the approximate direction 62 and 64 and will not be detected by the mass analyzer detector.

The range of the detectable m/z window around a certain mass can be adjusted with several variables and parameters. A set trapped ion release time of duration t1, a set delay time t2, a given width of the mesh aperture 38 and a given size of detector 36, for example, determines the m/z packet size along the direction 21 that is allowed to pass into time-of-flight tube drift region 60 and be detected by detector 36. The wider the aperture size on the mesh 38 and the larger the active area of detector 36, the larger will be the detected mass range. In addition, the trapped ion release time duration t1, determined by the voltage applied to lens 15 can be increased to reduce the component of Time-Of-Flight separation which occurs in the initial packet of ions released from ion guide 11 as the packet moves into TOF pulsing region 26. As the pulse width t1 of the lens 15 is increased, the duty cycle for ions pulsed into TOF tube 60 reduces approaching the duty cycle of the continuous or non trapping mode of operation and the m/z range of ions pulsed into time-of-flight tube 60 increases.

Figure 12:
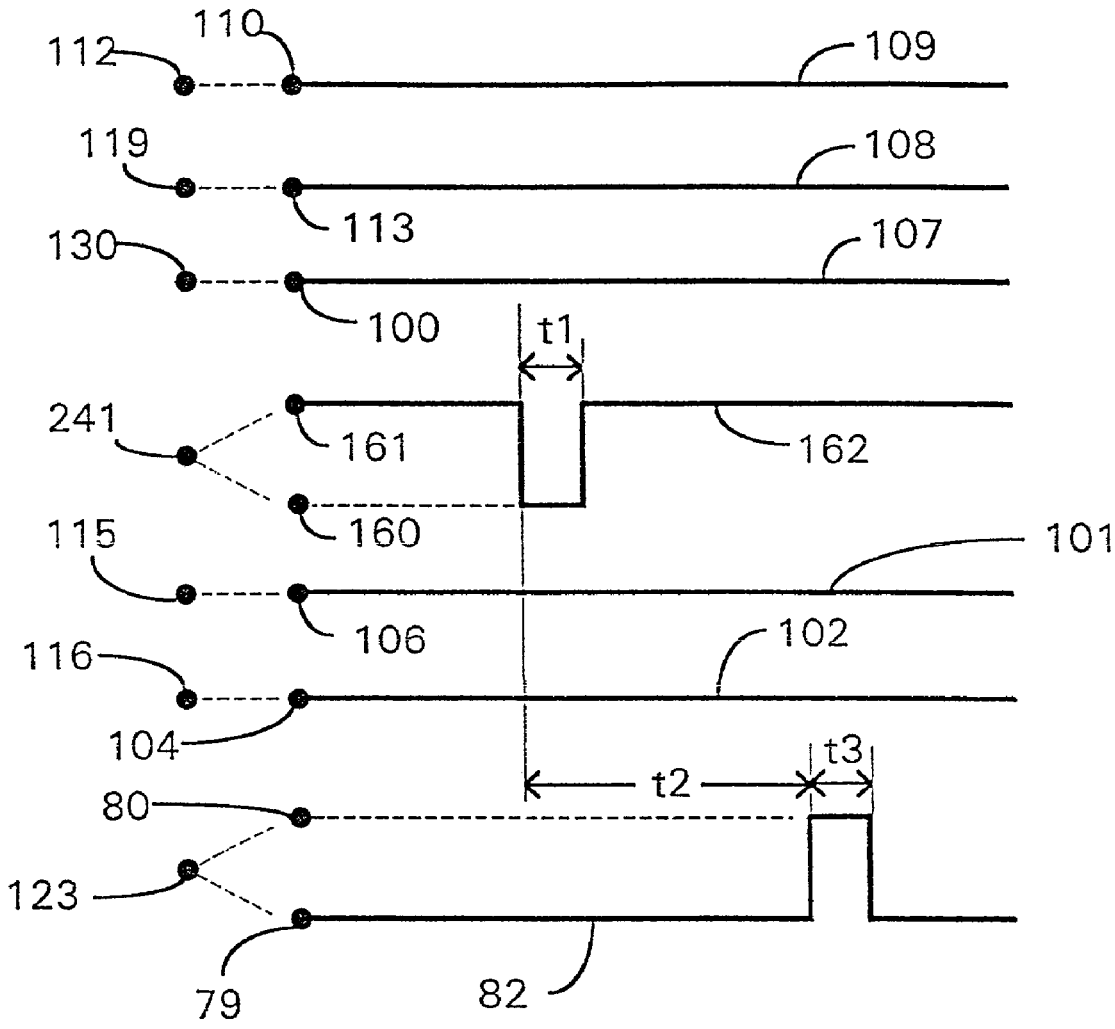
FIG. 12 is a timing diagram of an alternative ion trapping and release sequence from a segmented multiple ion guide including ion pulsing into the time-of-flight mass analyzer.

FIG. 11 illustrates the effect of increasing the ion release time t1. In FIG. 11A, ions in packet 142 have just been released from ions 143 stored in ion guide 140 by a dropping the trapping voltage applied to ion guide exit section 141 for a time period t1 as described below. As the ions in ion packet 142 move into time-of-flight pulsing region 26, different m/z value ions travel at different velocities resulting limited time-of-flight separation of different m/z values. Assume that ion packet 142 is originally comprised of ions having three different m/z values. As the ion moves into time-of-flight pulsing region 26, ion packet 142 separates into three ion packet 144, 145 and 146 each comprised o a singular m/z value. The ions in ion packet 146 have lower m/z value and consequently, a higher velocity in the primary beam direction than the higher m/z ions in ion packets 145 or 146. Ions in ion packet 145 have a lower m/z value than the ions in packet 144 and so forth. If delay t2 is selected such that the voltages on lenses 23 and 24 switch high when ion packet 145 is centered in pulsing region 26, then the entire ion packet 145 when pulse in direction 159 will be subject to time-of-flight analysis and will hit detector 36. Most ions in packets 144 and 146 will hit the non grid portion of lens 24 and consequently not be detected by detector 36 as was presented in an earlier section which described FIG. 4. With delays t1 and t2 set to produce the sequence shown in FIGS. 11A and B, ions of the m/z value included in packet 145 will be mass analyzed with very high duty cycle. If it is desirable to increase the m/z range which is mass analyzed per time-of-flight pulse, the ion release time t1 can be increased. Increasing t1 will increase the length of the initial released ion packet 142. The longer initial ion packet 142 results in less m/z component separation as the released ions move into TOF pulsing region 26. The resulting primary ion beam time-of-flight separation contains longer individual ion packets 150, 151 and 152 which are unable to entirely spacially separate ions with different m/z values in time-of-flight pulsing region 26. As is shown in FIG. 12C, a portion of the lower m/z ions in packet 152 is overlapped with a portion of the higher m/z ions in packet 151 and so forth. Ion packets 150, 151 and 152, normally aligned along the primary beam axis, are shown slightly offset to illustrate their respective overlap. Due to the increased length of ion packet 151, not all ions of the m/z values comprising packet 151 will clear lens 24 or 35 and arrive at detector 36 when the ions are pulsed out of TOF pulsing region 26. This is illustrated by trajectory trace 154. However, an increased number of ions in packets 150 and 152 will be subject to time-of-flight mass analysis and will hit detector 36 when they are pulse from of TOF pulsing region 26 in direction 153. Consequently, a longer trapped ion release period (larger delay t1), will result in a broader m/z range TOF mass analysis for each TOF pulse. An increased time period t1 may also result in a reduced duty cycle for ion m/z values roughly centered in the detected m/z range. By the appropriate choice of time periods t1 and t2, high duty cycle, and consequently high sensitivity, TOF mass analysis can be achieved for a given selected m/z range.

Figure 7A:
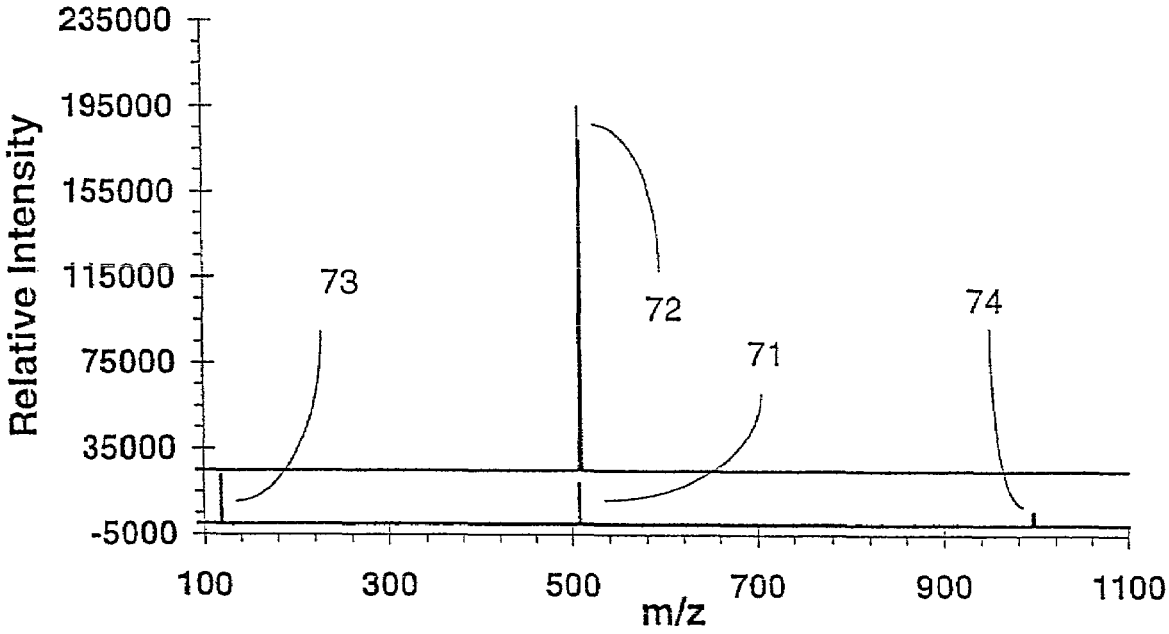
FIGS. 7A and B are the time-of-flight mass spectral comparison between the continuous and ion storage mode of operations.
Figure 7B:
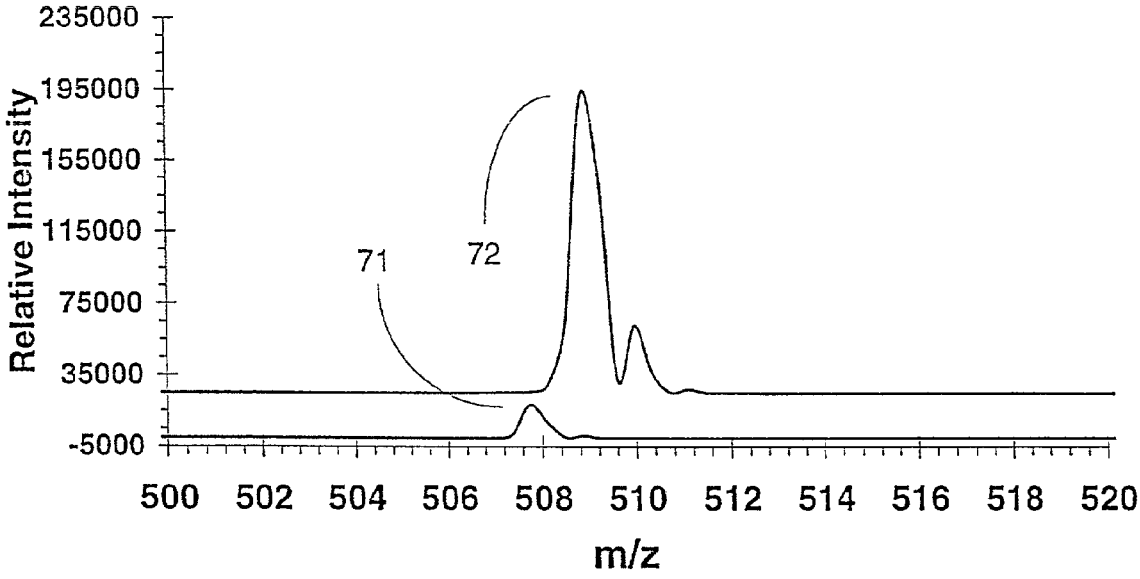

FIG. 7 shows the actual experimental results acquired using both the continuous and ion storage modes of operation for a sample containing a mixture of ions described in the above examples. The actual sample was a mixture of three compounds Valine, tri-tyrosine, and hexa-tyrosine. Upon electrospray ionization of this mixture, the predominant molecular ions with nominal masses 118, 508, and 997 are generated in external ion source 10. The bottom trace of FIG. 7A shows all three of these ions detected and registered as peaks 73, 71, and 74 when the mass spectrometer was operated in continuous mode. The top trace mass spectrum in FIG. 7A shows the results when the mass spectrometer was changed to the ion storage mode of operation. Both modes were acquired in similar experimental conditions. The time-of-flight pulse acquisition rate i.e. the repetition rate counted by the repeller lens was 8200 per second. Each trace represents 4100 full averaged pulses. As seen from the top spectral trace, there is only one predominant registered peak 72 in the spectrum. This peak corresponds to a molecular ion 508 enhanced in signal strength by about a factor often with respect to the peak 71 in continuous mode of operation. For the reasons explained in the examples given above, time periods t1 and t2 were set so that both of the molecular ions 118 and 997 are absent from the ion storage mode spectral trace as expected. The signal intensity increase comes from the fact that all of the ions that would otherwise be lost in the continuous ion mode were actually being stored in the ion guide for the next time-of-flight pulse. According to the above example, for the continuous mode of operation, the approximate duty cycle calculated for the 508 peak at 8,200 scans/s would be 9% i.e. one out of every twelve ions being detected. As the experimental results suggest in the ion storage mode of operation at 8,200 scans/s in FIG. 7, most of the lost ions predicted in the continuous ion mode were recovered. FIG. 7B shows the same spectral traces, except the m/z region is expanded between 500 and 520 to show the isotopic peaks in more detail. The slight shift between the peaks 71 and 72 is due to the different tuning conditions of ions by the voltages applied to lenses 16 and 17 that cause the ions to land in different position in the acceleration region 26. These differences result in the slight arrival time shifts of the ions at detector 36.

An alternative embodiment of the invention is diagrammed in FIG. 8. In the embodiment shown, a Time-Of-Flight apparatus 221 is comprised of atmospheric pressure ion source 210, capillary 212, skimmer 219 and ion guide 211 whose axis is aligned with the axis of Time-OF-Flight tube 260. Ions produce near atmospheric pressure in ion source 210 are transported into vacuum stage 220 through capillary tube 212. A portion the ions which enter vacuum are transferred through skimmer opening 213 into multipole ion guide 211. Multipole ion guide 211 extends continuously from vacuum stage 230 into vacuum stage 240 transporting ions from a high pressure to a low pressure vacuum region. Insulators 218 electrically isolate skimmer 219 and ion guide 211 from vacuum housing 222. The appropriate voltages can be applied to the capillary exit electrode, skimmer 219, ion guide 211, electrostatic lenses 215, 216 and 217 as described herein to selectively trap ions in ion guide 211 and release ions from the exit end of ion guide 211.

In the previous embodiment of the invention as diagrammed in FIG. 1 ions released from ion guide 11 were transferred from the exit region of ion guide 11 into pulsing region 26 where they were pulsed in the orthogonal direction into TOF tube 60. As diagrammed in FIG. 8, the axis of the TOF field free region or flight tube 260 located vacuum stage 250, is substantially aligned with the axis of multipole ion guide 211. Ion packets released from ion guide 211 traverse vacuum lenses 215, 216, 217 and orifice 228 and enter region 226 between electrostatic lenses 223 and 224. After the released ions enter region 26 the voltages applied to lenses 223 and 224 are increased to further accelerate the released ions through grid 235 and into flight tube 260 to impact on detector 236. The ion accelerating voltages set on lenses 223, 224 and 235 help to time space focus the ion packet 233 into a thinner cross section 234 at the face of detector 236 to maximize resolution. To achieve reasonable resolution with the linear ion guide and time-of-flight configuration, short ion release pulses, that is a short time period t1, must be used. An alternative linear configuration to that shown in FIG. 1 accomplished by combining ion guide exit lens 215 and time-of-flight pulsing lens 223 and, eliminating lenses 216 and 217. Pulsing trapped ions from ion guide 211 directly through grid 224 helps to minimize the initial released ion packet width and aids in increasing resolution. One operational difference between the linear ion guide TOF configuration shown in FIG. 8 and the orthogonal pulsing configuration shown in FIG. 1 is that all ions which are released from ion guide 211 will enter flight tube 260 independent of the duration of t1 and independent of ion m/z value. Mass to charge analysis resolution of the linear ion guide TOF embodiment can be improved by including an ion reflector or ion mirror in the TOF path. The methods described herein to trap and release ions from an ion guide with sequence orthogonal pulsing into a time-of-flight tube can be applied to the linear ion guide time-of-flight configuration diagrammed in FIG. 8 as well.

Using the orthogonal pulsing geometry TOF as the preferred embodiment, alternative ion trapping and release methods can be employed to enhance overall time-of-flight instrument performance. Such alternative embodiments of the invention are described below. The trapping of ions in ion guide 11, the releasing of ions from ion guide 11 and pulsing of the released ions into time-of-flight tube 60 can be accomplished, as has been described above, by the gating and pulsing sequence diagramed in FIG. 6. In the preferred embodiment of the invention shown in FIG. 6, the voltage applied to ion guide exit lens 15 is switched high to achieve ion trapping and low, relative to the ion guide bias or offset potential, to release positive ions trapped in ion guide 11. The voltage polarities applied to ion guide exit lens 15 are reversed for negative ions. That is, the voltage applied to ion guide exit lens 15 to trap negative ions in ion guide 11 must be set more negative that the ion guide offset potential. For either ion polarity, to achieve a rapid transition between voltage levels applied to electrostatic lens 15, switch 92 switches between different power supply 91 outputs set at the appropriate voltages, applying the output voltage of a selected power supply to lens 15. Alternatively, the voltage level applied to lens 15 can be varied by changing the output voltage of a single power supply controlled through appropriate input signals such as a digital to analog converter input signal means. For a given ion guide bias or offset potential, a potential in excess of 50 to 60 volts above the ion guide offset potential, for positive ions, may be applied to effectively trap ions in ion guide 11. Such a high voltage differential between the ion guide bias and exit lens 15 potential may be required to trap ions experiencing increasing space charge repulsion as ions fill the two dimensional ion guide trap. The effect of increasing space charge can cause trapped ions to exit the ion guide 11 with an average energy greater than the bias potential.

A relatively high ion guide exit lens trapping potential, effective at trapping ions in ion guide 11, may also have the effect of pushing the trapped ions back into the ion guide away from the ion guide exit end. The trapping voltage applied to exit lens 15 may cause a DC electric field penetration into the ion guide exit end effectively moving the trapped ions further into ion guide 11 away from ion guide exit region 72. Under these conditions, when the trapping voltage applied to lens 15 is lowered, trapped ions must first move through ion guide 11 towards ion guide exit region 72 before being accelerated and focused into pulsing region 26. Ions released from well inside ion guide 11, have further to travel into pulsing region 26 and will experience a greater Time-Of-Flight separation prior to entering time-of-flight pulsing region 26. In this manner, the range of m/z values pulsed into Time-Of-Flight tube 60 may be reduced. However, if it is desirable to maximize the duty cycle and m/z range of ions pulsed into Time-Of-Flight tube 60, the distance the released ions travel prior to being pulsed into time-of-flight tube 60, should be minimized. Reduced time-of-flight separation of ions in the released primary ion beam occurs as the distance that the released ions are required to travel into pulsing region 26 is decreased. Alternative methods can be used to trap ions in ion guide 11 which minimizes the trapped ion displacement from exit end 72 into ion guide 11. One such alternative method is diagrammed in FIG. 9A. The timing diagram shown in FIG. 9A shows the time sequence of voltage levels applied to electrostatic lenses 23, 15 and 16 and the DC offset potential applied to the rods ion guide 11.

Figure 9:
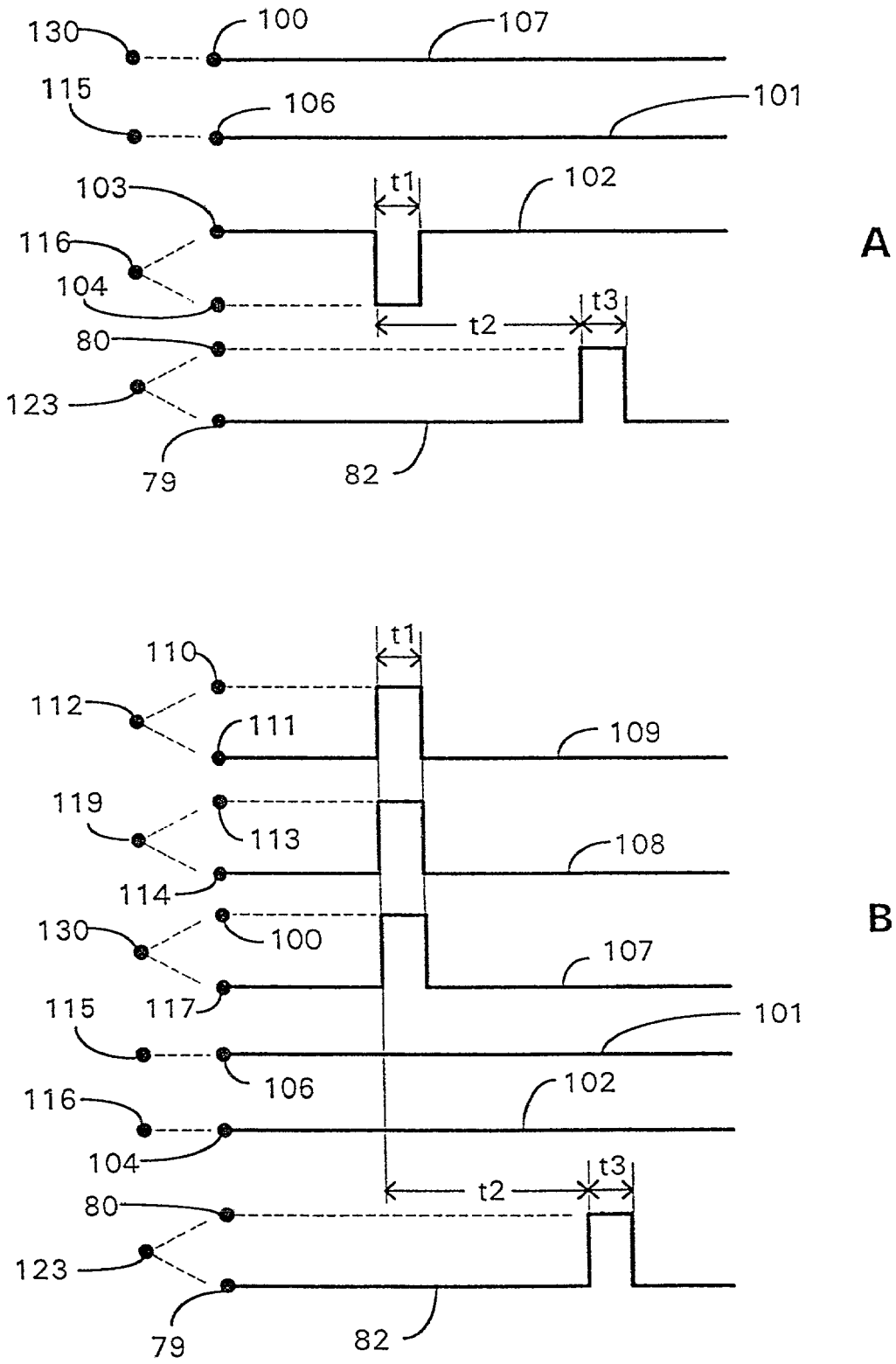
FIGS. 9A and B are timing diagrams of alternative ion trapping and release sequences by varying voltages applied to lenses other than the ion guide exit lens including ion pulsing into the time-of-flight mass analyzer.

Referring to FIG. 9A, potentials 79 or 80 can be applied to pulsing lens 23 through switch connection 123. In like manner potentials 103 and 104 can be applied to electrostatic lens 16 through switch connection 116. Voltage level 106 applied to electrostatic lens 15 through connection 115 remains constant through the trapped ion release and Time-Of-Flight pulse cycle as indicated by trace 101. Similarly, the ion guide offset potential 100 applied to the ion guide rods through switch connection 130 also remains constant during the trapped ion release and subsequent Time-Of-Flight pulse cycle as illustrated by trace 107. Using the method diagrammed in FIG. 9A, positive ions are trapped in ion guide 11 by increasing the voltage applied to electrostatic lens 16 while leaving the potential applied to ion guide exit lens 15 at its optimal ion release voltage. The increased potential applied to lens 16 creates a electric field which penetrates through the center aperture of lens 15, trapping ions in ion guide 11 while minimizing the field penetration into exit end region 72 of ion 11. Applying trapping potential 103 to lens 16 and not to lens 15 localizes the trapping field to a region close to the centerline of primary ion beam 21 while minimizing the electric field penetration into exit end region 72 of ion guide 11. The location of ions trapped in ion guide 11 can extend close to exit end 72 of ion guide 11 with this alternative trapping method. Ions are released from ion guide 11 by switching the voltage applied to lens 16 through switch connection 116 from potential level 103 to 104 for time period t1. After a selected delay of duration t2, which corresponds to the time required for the desired m/z value ions to traverse the distance from ion guide exit 72 into pulsing region 26, the potential applied to lens 23 is switched from level 79 to 80 for a time period of t3 as shown by traces 102 and 82 in FIG. 9. Using this ion trapping and release method, ions will travel a minimum distance into pulsing region 26 and hence experience reduced initial ion beam Time-Of-Flight separation prior to being pulsed into Flight tube 60. Reduced primary beam m/z separation results in increased duty cycle for a broader m/z range pulsed into TOF tube 60. The same effect can be achieved for negative ions by reversing the polarity of DC potentials applied to lens elements and the ion guide rods while retaining the voltage switching timing sequence as diagrammed in FIG. 9.

Figure 10:
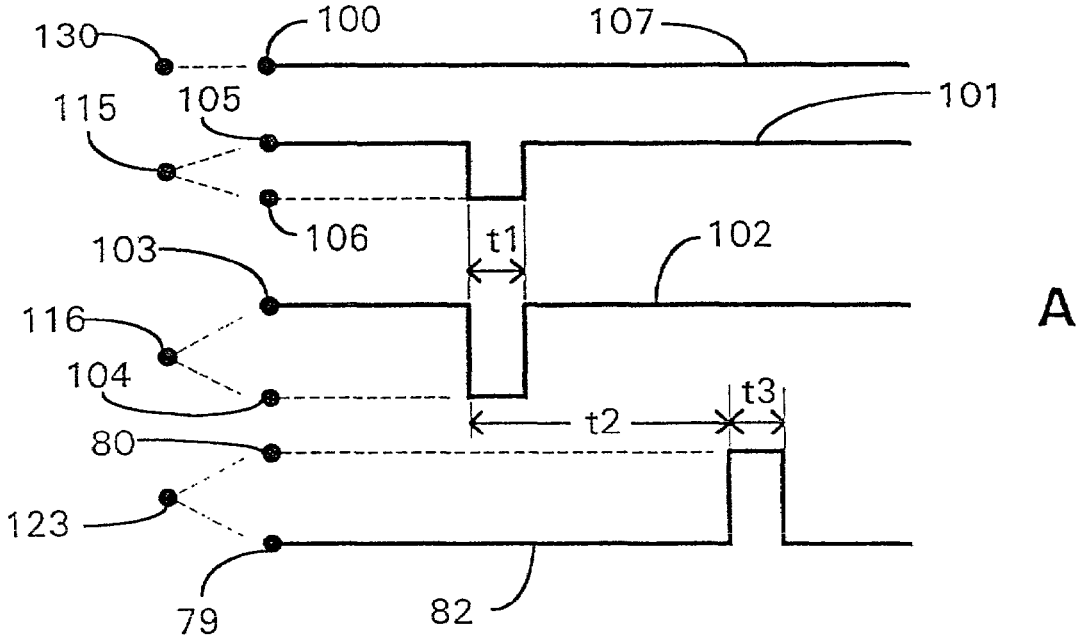
FIGS. 10A and B are timing diagrams of alternative ion trapping and release sequences by varying voltages applied to lenses positioned after the ion guide exit including ion pulsing into the time-of-flight tube.
Figure 10:
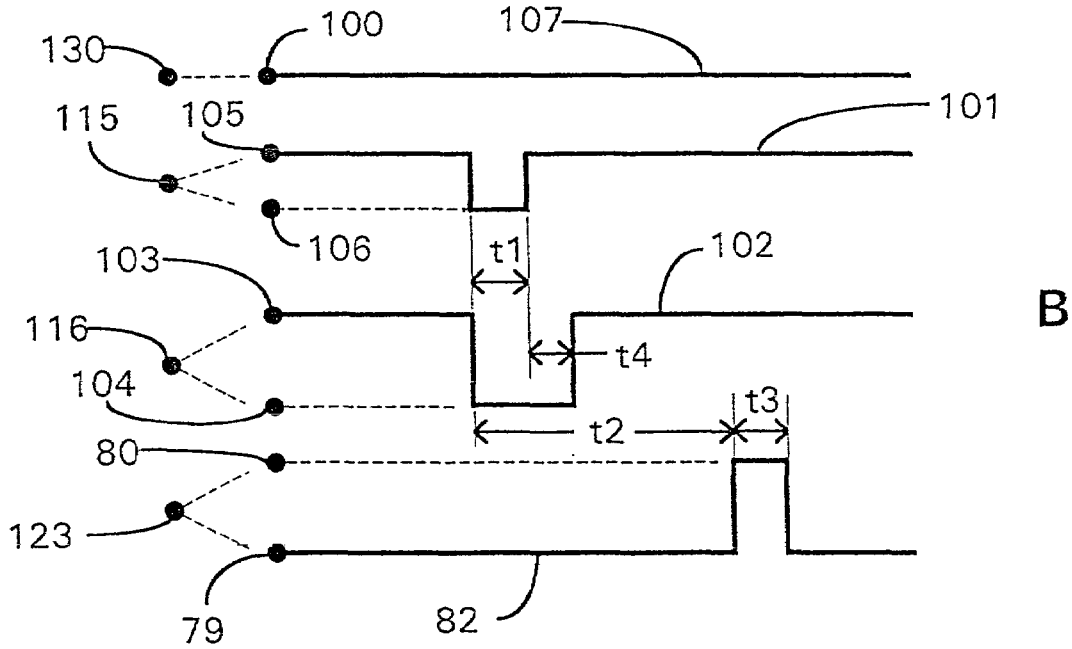

Two variations of the ion trapping and release method shown in FIGS. 10A and B can be used to achieve more precise control of the ion trapping and release from ion guide 11 while reducing the DC field penetration into ion guide exit region 72. FIG. 10A shows a method whereby ions are trapped in ion guide 11 by increasing the potentials on both lenses 15 and 16. Trapping potential 105 applied to lens 15 through switch connection 115 compliments trapping potential 103 applied to lens 16 through switch connection 116. The trapping potential 105 applied to lens 15 can be reduced relative to trapping potential 103 applied to lens 116 to create an electric field gradient at ion guide exit 72 which efficiently traps ions in ion guide 11 while minimizing the trapping DC field penetration into ion guide exit 72. Ions are released from ion guide exit end 72 by dropping the potential applied to lenses 15 and 16 to their optimal ion accelerating and focusing voltages 106 and 104 respectively. After gating or release period t1 the potentials applied to lenses 15 and 16 are increased to trap positive ions in ion guide 11 as shown by traces 101 and 102. In this method the ion guide offset potential 100 remains constant during the trap, release and pulse cycles as shown by trace 107. Ions released from ion guide 11 during the release time period t1 are pulsed into flight tube 60 after time delay t2 as shown by trace 82 of the potential applied to lens 23 through switch connection 123. In this method where lenses 15 and 16 are switched together, the relative trapping voltages applied to lenses 15 and 16 and the ion guide offset potential can be set to maximize the ion trapping efficiency while minimizing trapping field penetration effects in ion guide 11.

Depending on the rise time and magnitude of the trapping potentials applied to lenses 15 and 16 in the ion trapping method diagrammed in FIG. 10A, the rapid increase in voltage simultaneously applied to lense 15 and 16 may cause fragmentation of trapped ions in ion guide 11. When the trapping potentials are raised on lenses 15 and 16 with the potential on lens 15 less than that applied to 16, ions located in the gap between lenses 15 and 16 during the voltage transition can be accelerated back into ion guide 11. If the trapping potential applied to lenses 15 and 16 relative to ion guide offset potential 130 is high enough and the trapping voltage transition is rapid, ions re-accelerated back into ion guide 11 may collide with the background neutral gas near entrance 71 of ion guide 11 with enough energy to cause Collisional Induced Fragmentation (CID). In some analytical applications this method of achieving CID and even high energy CID may be desirable. When this CID method is not desired, however, a different trapping and release timing sequence can be used as diagrammed in FIG. 10B. Similar to the method diagrammed in FIG. 10A, trapping potentials 105 and 103 are applied to lenses 15 and 16 respectively. Positive ions are released from ion trap 11 by dropping the potentials applied to lenses 15 and 16 to values 106 and 104 respectively. After the ion release time period, t1, the potential applied to lens 15 is raised to 105 to trap ions in ion guide 11 while the potential applied to lens 16 remains at value 104. At this point ions initially located between lenses 15 and 16 are accelerated in the direction of pulsing region 26 away from ion guide 11. After time period t4 when the ions have cleared the gap between lenses 15 and 16, the potential applied to lens 16 is increased to value 103. Ions released from ion guide 11 in this manner are pulsed into time-of-flight tube 60 after time duration t2 with the duration of the time-of-pulse being time t3. The ion guide offset potential remains constant during this trap and release cycle. Traces 107, 101, 102 and 82 illustrate the relative timing of the applied ion trapping and release voltage sequence for this method.

The ion trapping and release methods diagrammed in FIGS. 6, 9A, 10A and 10B can cause some ion loss and hence a reduction in duty cycle when the potentials are raised on lenses 15 and 16 to retrap ions in ion guide 11. With the ion trapping and release method shown in FIG. 6, ions located between lens 15 and 16 when the potential on lens 15 is increased to trap ions, are accelerated at a faster rate through pulsing region 26 due the increased electric field between lenses 15 and 16. These faster moving, higher energy ions, even if pulsed into flight tube 60 may not hit detector 36. Similarly, with the ion trapping and release sequences shown in FIGS. 9A, 10A and 10B, ions located between lenses 15, 16 and 17 may be lost when the potentials are raised on lenses 15 and 16 to trap ions in ion guide 11. A method to minimize ion loss during the trapping and release of ions in ion guide 11 is diagrammed in FIG. 9B. In the method shown in FIG. 9B, the optimal accelerating and focusing potentials 106 and 104 applied to lenses 15 and 16 respectively, during ion release from ion guide 11, remain constant throughout the ion trapping and release sequence. The potentials applied to lenses 15 and 16 during the ion trap, release and pulse sequence is given by traces 101 and 102 respectively in FIG. 9B. Instead of raising the potential of lens 15 or 16 to trap ions, ions are trapped in ion guide 11 instead by lowering the offset or bias potential applied to the ion guide 11 rods to value 117 through switch contact 130 as shown by trace 107. To insure that ions continue to enter ion guide 11 during the trapping and release periods, the potentials applied to skimmer 19 through switch contact 119 and capillary 12 exit electrode through switch contact 112 track the ion guide offset potential changes. During the positive ion trapping period, DC potentials 111, 114 and 117 are applied to capillary 12 exit electrode, skimmer 19 and ion guide 11 rods respectively such that the relative DC potentials between these elements allow optimal ion transmission into ion guide 11. The relative DC potentials between the capillary 12 exit electrode and skimmer 19 may also be set to cause CID in the capillary to skimmer region. When capillary 12 is comprised of a dielectric material with electrodes coating the entrance and exit ends, the capillary entrance and exit potentials can differ by even kilovolt voltages without effecting ion transmission from an atmospheric pressure ion source 10 into vacuum as described in U.S. Pat. No. 4,542,293. Consequently the voltage applied to the capillary exit can vary by the tens of volts required to trap ions in ion guide 11 without the need to change voltages applied to the capillary entrance electrode or other electrostatic elements in API source 10. Varying the capillary exit voltage by tens of volts to enable ion trapping and release in ion guide 11 has minimal effect on the efficiency of transmitting ions from atmosphere to vacuum through capillary 12. When a dielectric capillary is configured in the external ion source time-of-flight embodiment diagrammed in FIGS. 1, 2 or 8, the voltages applied in the ion source remain optimized and the relative capillary exit, skimmer and ion guide offset voltages remain optimized for ion transmission into ion guide 11 throughout the ion trap and release cycle diagrammed in FIG. 9B. However, if it is desirable to prevent ions from entering ion guide 1 during any portion of the trapping and release cycle, say to achieve m/z selection of trapped ions, the capillary exit potential can be set to prevent ions from reaching skimmer orifice 13.

n the sequence diagrammed in FIG. 9B, positive ions are released from ion guide 11 by switching the voltages applied to the capillary 12 exit electrode, skimmer 19 and the bias voltage applied to the rods of ion guide 11 to values 110, 113 and 100 respectively. Ions are free to exit ion guide during the ion release period t1. To end the ion release period and trap the remaining ions in ion guide 11, potentials 111, 114 and ion bias potential 117 are applied to the capillary 12 exit electrode, skimmer 19 and the ion guide 11 rods respectively. After delay t2 from the start of the ion release period, the released ions are pulsed into TOF tube 60 by increasing the potential applied to lens 23 from voltage value 79 to 80 as shown by trace 82. The TOF pulse duration is time t3. In the ion trapping and release method diagrammed in FIG. 9B, ions located between lenses 15 and 16 and 16 and 17 are unaffected by the end of the release pulse and continue to move into pulsing region 26 with an optimal energy and trajectory. Ions located in the small gap between ion guide exit region 72 and lens 15 are directed back into ion guide 11 when the ion guide bias potential is lowered to retrap ions. Consequently, little or no ion loss results from the ion trapping and release sequence shown in FIG. 9B. For negative ion trapping in ion guide 11 with release into pulsing region 26, the voltage polarities applied to lens and ion guide elements diagrammed in FIG. 9B are reversed.

Yet another embodiment of the invention is shown in FIG. 11 where segmented multipole ion guide 140 is configured with exit section 148. Each rod 147 of ion guide 140 is configured with a segment 141 of the same rod shape positioned at its exit end. Each segment 141 is electrically isolated from its respective rod 147. A given rod 147 and its electrically isolated exit segment 141 have the same RF frequency, amplitude and phase applied. The electrical isolation of each exit segment from its respective rod allows a different DC bias potential to be applied to the rod portion 149 and the exit segment portion 148 of ion guide 140 during operation. As with a non-segmented ion guide, adjacent rods and exit segments have the same RF amplitude and frequency applied but a phase shift of 180 degrees. Ion guide 140 can be operated in RF only mode or mass selection mode using AC and DC filtering, resonant frequency ejection or RF amplitude variation. Segmented ion guide 140 can be configured as a quadrupole, hexapole, octopole or with more than 8 rods.

The DC bias potential applied to ion guide exit segments 141 can be varied to trap ions in section 149 of ion guide 140 or to release ions from exit region 158 of segmented ion guide 140. A method to achieve such ion trapping is diagrammed in FIG. 12. Throughout the ion trapping and release sequence shown in FIG. 12, voltages 106 and 104 applied to electrostatic lenses 15 and 16 respectively remain constant during the ion trapping and release cycle. This is illustrated by traces 101 and 102 of the voltages applied to lenses 15 and 16 respectively. Similarly, the potentials 110, 113 and the ion guide section 149 bias potential 100 applied to capillary exit electrode 155, skimmer 19 and rods 147 of ion guide section 149 respectively remain constant throughout the ion trapping and release cycle. Traces 109, 108, and 107 illustrate the DC voltages applied to capillary exit electrode 155, skimmer 19 and rods 147 of ion guide section 149 respectively. Positive ions are trapped in section 149 of ion guide 140 when the DC bias potential applied to segments 141 of ion guide section 148 is set at value 161 which is higher than the DC bias voltage applied to rods 147 of ion guide section 149. Positive ions traversing the capillary to skimmer region 156 continue to enter ion guide 14 through entrance 157 region during trapping. The potential applied to skimmer 19 is set higher than the bias voltage applied to the rods of ion guide section 149. This serves the dual purpose of aiding in the transfer of ions into the entrance of ion guide 140 while preventing trapped ions from leaving. The velocity of trapped ions moving toward entrance region 157 of ion guide 140 is reduced due to collisions with neutral gas expanding from capillary 12 through the orifice in skimmer 19. Consequently, the combined effect of gas phase collisions and relative DC trapping potentials set between the skimmer and ion guide 140 section 149 prevent trapped ions from leaving ion guide section 149 through entrance region 157.

Trapped ions are released from ion guide 140 section 149 when the bias potential applied to ion guide exit section 148 through switch contact 241 is lowered to value 160 for time period t1. The DC bias potential applied to ion guide exit section 148 is increased after time t1 to trap ions in ion guide section 149 as shown by trace 162 in FIG. 12. Released ions move from ion guide exit region 158 into TOF pulsing region 26. The potential applied to lens 23 is raised from value 79 to 80 to pulse ions into TOF tube 60 after time delay t2 from the starting point of the ion release from ion guide 140. The TOF pulse duration is t3. With the segmented ion guide 140 configuration shown in FIG. 11, other ion trap and release sequence combinations are possible which include simultaneous switching of voltages applied to lens elements 155, 19, 147, 141, 15 and 16 as described herein and as may be apparent to one skilled in the art. Combinations of voltage switching and timing may be selected through delay generator 93 and switch 92 to achieve maximum sensitivity, narrower m/z range, higher resolution TOF m/z analysis or ion CID fragmentation.

Consequently, in summary and conclusion, an improved apparatus for analyzing ionic species using a time-of flight mass analyzer is provided herein. In the preferred embodiment, the apparatus, has an atmospheric pressure ionization source which produces ions for transmission to a time-of-flight mass analyzer. Other types of external ion sources including but not limited to Atmospheric pressure ion sources such as Electrospray (ES), Atmospheric Pressure Chemical Ionization (APCI) or Inductively Coupled Plasma (ICP) ion sources or vacuum based sources such as Matrix Assisted Laser Desorption (MALDI), electron ionization (EI) or Chemical Ionization (CI) may be configured to supply ions in this invention. The apparatus has at least one two dimensional ion guide positioned between the external ion source and the time-of-flight mass analyzer to enhance the efficiency of transmission of the ions. The multipole ion guide is configured with a set of equally spaced, parallel rods and can be operated in the RF-only or RF-DC mode of operation, having an ion entrance section where ions supplied from said external ion source enter said ion guide and an ion exit section where ions exit the ion guide, and having an ion entrance lens positioned near the ion guide entrance region and an ion exit lens located near the ion guide exit region. In one embodiment of the invention, the multipole ion guide is positioned such that the ion entrance section of the ion guide is placed in a region where background gas pressure is greater than the free molecular flow regime, and such that the pressure along the ion guide at the ion exit section drops to the free molecular flow pressure regime along the ion guide length. The multipole ion guide is operated in the ion storage mode using a voltage switching or adjusting device to change the relative voltage levels applied to the ion guide rods and surrounding electrostatic lenses. The apparatus further has a time-of-flight acceleration region where trapped ions released from the multipole ion guide are pulsed into the time-of-flight tube to be mass analyzed. The released ions can be injected into the time-of-flight acceleration region in the linear or orthogonal directions relative to the ion guide axis. A detector is also provided where the ions are mass analyzed according to their arrival times, and an accurate timing device is provided that synchronizes the time-of-flight ion pulsing device with said ion arrival times. A device is also described which determines the respective voltage levels and the duration of the voltage levels applied to the ion guide and surrounding lenses and the time-of-flight lenses elements.

Having described this invention with respect to specific embodiments, it is to be understood that the description is not meant as a limitation since further modifications and variations may be apparent or may suggest themselves to those skilled in the art. It is intended that the present application cover all such modifications and variations as fall within the scope of the appended claims.

REFERENCES CITED

The following references referred to above are hereby incorporated herein by reference:

U.S. Patent Documents:

U.S. Pat. No. 5,179,278 Jan. 12,1993 D. J. Douglas

U.S. Pat. No. 2,685,035 Jul. 27, 1954 W. C. Wiley

Foreign Patent Documents:

SU 1681340 A1 Feb. 25,1987 USSR Patent Dodonov et al.

Other References Cited:

C. Beaugrand and G. Devant, Ion Kinetic Energy Measurement on Tandem Quadrupole Mass trometers, 35 th ASMS Conference on Mass Spectrometry and Allied Topics, Denver, Colo. (1987).

J. G. Boyle, C. M. Whitehouse, J. B. Fenn, Rapid Commun. Mass Spectrom. 5, 400 (1991).

B. M. Chien, S. M Michael, D. Lubman, Int. J. Mass Spect. Ion Proc. 131, 149 (1994).

J. H. J. Dawson, M. Guilhaus, Rapid Commun. Mass Spectrom. 3, 155 (1989).

A. F. Dodonov, I. V. Chernushevich, V. V. Laiko, 12$^{th}$ Int. Mass Spectr. Conference, Amsterdam (1991).

G. G Dolnikowski, M. J. Kristo, C. G. Enke, and J. T. Dawson, Intl. Jour. of Mass Spec. Ion Proc., 82, p.1–15, (1988), Ion Trapping Technique for Ion/Molecule Reaction Studies in the Center Quadrupole of a Triple Quadrupole Mass Spectrometer.

R. Grix, U. Gruner, G. Li, H. Stroh, H. Wollnik, Int J. Mass Spect. Ion Proc. 93,323(1989).

R. F. Herzog, Z. Phys. 89 (1934), 97 (1935); Z. Naturforsch 8a, 191 (1953), 10 a, 887

V. I. Karataev, B. A. Mamyrin, D. V. Shmikk, Sov. Phys. Tech. Phys. 16, 1177 (1972).

V. V. Laiko and A. F. Dodonov, Rapid Commun. Mass Spectrom. 8, 720 (1994).

B. A. Mamyrin, V. I. Karataev, D. V. Shmikk, V. A. Zagulin, Sov. Phys. JETP 37, 45 (1973).

S. M Michael, M. Chien, D. M. Lubman, Rev. Sci.Instrum. 63 (10), 4277 (1992).

O. A. Migorodskaya, A. A. Shevchenko, I. V. Chernushevich, A. F. Dodonov, A. I. Miroshnikov, Anal. Chem. 66, 99 (1994).

A. V. Mordehaj, G. Hopfgartner, T. G. Huggins, J. D. Henion, Rapid Commun. Mass Spectrom. 6, 508(1992).

A. Mordehai, J. Karnicky, B. Limbek, and S. E. Buttrill, Jr., "A New LC Electrospray Ion Time-Of Flight Mass Spectrometer", 43 rd ASMS Conference on Mass Spectrometry and Allied Topics, Atlanta, Ga. (1995).

G. J. O'Halloran, R. A. Fluegge, J. F. Betts, W. L. Everett, Report No. ASD-TDR 62-644, Prepared Contract AF 33(616)-8374 by The Bendix Corporation Research Laboratories Division, Southfield, Mich. (1964).

A. N. Verentchikov, W. Ens, K. G. Standing, Anal. Chem. 66, 126 (1994).

W. C. Wiley, I. H. McLaren, Rev. Sci. Inst. 26, 1150 (1955).

What is claimed is:

1. An apparatus for analyzing chemical species comprising:

(a) a time-of-flight mass analyzer with an ion pulsing region and a detector, (b) an ion source for producing ions forming an ion beam from said chemical species, (c) a two-dimensional multipole ion guide having an ion guide axis and having an entrance end where ions enter said ion guide from said ion source and an exit end where ions exit said ion guide, wherein said two-dimensional multipole ion guide comprises a plurality of spaced apart rods parallel to each other and to said ion guide axis and extending from said entrance end to said exit end, and wherein said two-dimensional ion guide functions to trap ions within said ion guide in directions orthogonal to said ion guide axis, (d) means to controllably trap ions in said ion guide in the direction of said ion guide axis and controllably release ions from said ion guide into said pulsing region, (e) means for pulsing said ions, transferred into said pulsing region, into said time-of-flight mass analyzer for mass analysis, and (f) means for detecting said mass analyzed ions with said detector.

2. An apparatus as set forth in claim 1 comprising means to control the timing of said means for pulsing said ions transferred into said pulsing region.

3. An apparatus as set forth in claim 1, wherein said ions in said multipole ion guide are scanned at a scan rate sufficiently rapid to prevent excessive charge buildup in said multipole ion guide.

4. The apparatus of claim 1, further comprising an ion guide bias voltage applied to said ion guide, wherein said means to controllably trap ions in said ion guide in the direction of said ion guide axis and controllably release ions from said ion guide into said pulsing region comprises means to change the voltages on lens elements positioned near said ion guide exit relative to said ion guide bias voltage.

5. The apparatus of claim 1, further comprising an ion guide bias voltage applied to said ion guide, wherein said means to controllably trap ions in said ion guide in the direction of said ion guide axis and controllably release ions from said ion guide into said pulsing region comprises means to change said ion guide bias voltage relative to voltages on lens elements positioned near said ion guide exit.

* * * * *